US006662146B1

(12) United States Patent
Watts

(10) Patent No.: US 6,662,146 B1
(45) Date of Patent: Dec. 9, 2003

(54) METHODS FOR PERFORMING RESERVOIR SIMULATION

(75) Inventor: James W. Watts, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 09/441,530

(22) Filed: Nov. 16, 1999

Related U.S. Application Data

(60) Provisional application No. 60/109,818, filed on Nov. 25, 1998.

(51) Int. Cl.[7] ..... G06G 7/48; G06G 7/50; G06F 17/10

(52) U.S. Cl. ..... 703/10; 703/2; 703/9

(58) Field of Search ..... 703/9, 10, 2

(56) References Cited

U.S. PATENT DOCUMENTS 6,052,520 A * 4/2000 Watts, III ..... 702/13
6,230,101 B1 * 5/2001 Wallis ..... 702/14

OTHER PUBLICATIONS

Young et al., "A Generalized Compositional Approach for Reservoir Simulation", Society of Petroleum Engineers Journal, Oct. 1983, pp 727–742.*

Joubert et al., "Evaluation of Linear Solvers for Oil Reservoir Simulation Problems Part 2: The Fully Implicit Case", Los Alamos National Laboratory, Sep. 1997, pp 1–9.*

Mifflin et al., "A Fully Coupled, Fully Implicit Reservoir Simulator for Thermal and Other Complex Reservoir Processes," SPE 21252, © 1991, Society of Petroleum Engineers, Inc., pp. 457–470.

Farkas, "Linearization Techniques of Reservoir Simulator Equations: Fully Implicit Cases," SPE 37984, © 1997, Society of Petroleum Engineers, Inc., pp. 87–95.

Lett, "Fully Implicit Reservoir Simulation Using Black–Box Multigrid," 1992, pp. 571–578.

Watts, "A Total–Velocity Sequential Preconditioner for Solving Implicit Reservoir Simulation Matrix Equations,"© 1999, Society of Petroleum Engineers, Inc., pp. 283–284.

International Search Report for Application No. PCT/US 99/28137, mailed Jun. 2, 2000.

Coats, K.H., *A Note on Impes and Some Impes–Based Simulation Models*, SPE 49774, SPE Reservoir Simulation Symposium, Feb. 14–17, 1999, pp. 21–39.

(List continued on next page.)

*Primary Examiner*—Hugh Jones
*Assistant Examiner*—Herng-der Day
(74) *Attorney, Agent, or Firm*—Meyertons Hood Kivlin Kowert & Goetzel, P.C.; Jeffrey C. Hood

(57) ABSTRACT

A method for performing reservoir simulation by solving a mixed implicit-IMPES matrix (MIIM) equation. A variable implicit reservoir model comprises implicit cells and IMPES cells. The MIIM equation includes a first scalar IMPES equation for each IMPES cell and a set of implicit equations for each implicit cell. The simulation method comprises: (a) constructing a global IMPES pressure equation; (b) solving the global IMPES pressure equation for pressure changes; (c) computing first residuals at the implicit cells; (d) determining improved saturations by solving the total velocity sequential equations at the implicit cells; (e) computing second residuals at the implicit cells and at IMPES cells in flow communication with the implicit cells. Steps (b) through (e) are repeated until a convergence condition is satisfied. Alternative to step (d), improved saturations and improved pressures may be computed by performing one or more iterations with a selected preconditioner at the implicit cells.

20 Claims, 9 Drawing Sheets

OTHER PUBLICATIONS

Fung, Larry S–K, Collins, David A. and Nghlem, Long X, *An Adaptive–Implicit Switching Criterion Based on Numerical Stability Analysis*, SPE 16003, SPE Reservoir Engineering, Feb. 1989, pp 45–51.

Russell, T.F., *Stability Analysis and Switching Criteria for Adaptive Implicict Methods Based on the CFL Condition*, SPE 18416, SPE Symposium on Reservoir Simulation, Feb. 6–8, 1989, pp 97–107.

Young, L.C. and Russell, T.F., *Implementation of an Adaptive Implicit Method*, SPE 25245, SPE Symposium on Reservoir Simulation, Feb. 28–Mar. 3, 1993, pp 113–126.

Wallis, J.R., Kendall, R.P. and Little, T.E., *Constrained Residual Acceleration of Conjugate Residual Methods*, SPE 13536, SPE Reservoir Simulation Symposium, Feb. 10–13, 1985, pp 415–428.

Wallis, J.R., *Incomplete Gaussian Elimination as a Preconditioning for Generalized Conjugate Gradient Acceleration*, SPE 12265, SPE Reservoir Simulation Symposium, Nov. 15–18, 1983, pp 325–334.

Watts, J.W., and Rame, M., *An Algebraic Approach to the Adaptive Implicit Method*, SPE 51900, SPE Reservoir Simulation Symposium, Feb. 14–17, 1999, pp. 3–10.

Behie, A and Vinsome, P.K.W., *Block Iterative Methods for Fully Implicit Reservoir Simulation*, SPE 9303, Copyright 1982 Society of Petroleum Engineers of AIME, Oct. 1982 pp 658–668.

Thomas, G.W. and Thurnau, D.H., *Reservoir Simulation Using an Adaptive Implicit Method*, SPE 10120, Copyright 1983 Society of Petroleum Engineers of AIME, Oct. 1983, pp 759–768.

Spillette, A.G., Hillestad, J.G. and Stone, H.L., *A High–Stability Sequential Solution Approach to Reservoir Simulation*, SPE 4542, Copyright 1973 American Institute of Mining, Metallurgical and Petroleum Engineers, Inc., pp 1–14.

Forsythe, P.A. and Sammon, P.H., *Practical Considerations for Adaptive Implicit Methods in Reservoir Simulation*, Journal of Computational Physics 1986, pp 265–281.

* cited by examiner

METHODS FOR PERFORMING RESERVOIR SIMULATION

PRIORITY DATA

This application claims benefit of priority of provisional application Ser. No. 60/109,818 titled "System and Method for Improved Reservoir Simulation" filed Nov. 25, 1998 whose inventor is James W. Watts.

FIELD OF THE INVENTION

The present invention relates to reservoir simulation, and in particular, to methodologies for performing reservoir simulation by solving an implicit matrix equation or an implicit-IMPES matrix equation.

BACKGROUND OF THE INVENTION

In an attempt to understand and predict the physical behavior of reservoirs (such as petroleum reservoirs), reservoir engineers and scientists have generated various mathematical descriptions of reservoirs and the fluids they contain. These mathematical descriptions are often expressed as coupled sets of differential equations. Since it is quite often impossible to obtain solutions of the differential equations in all but the simple cases, the differential equations are discretized in space and time, and the resulting difference equations are solved using various numerical simulation techniques. For example, the following difference equations represent the volumetric accumulation of oil and water in a particular cell (i.e. cell i) over the course of a timestep from time index n to n+1 assuming rock and fluid incompressibility in a one-dimensional reservoir:

$$(\lambda_o)^{\beta}_{i+1/2}[(p_o)^{\alpha}_{i+1}-(p_o)^{\alpha}_{i}]-(\lambda_o)^{\beta}_{i+1/2}[(p_o)^{\alpha}_{i}-(p_o)^{\alpha}_{i-1}]+(q_o)^{\beta}_{i}=\frac{\phi V_i}{B_o\Delta t}[(S_o)^{n+1}_{i}-(S_o)^{n}_{i}], \tag{B1}$$

$$(\lambda_w)^{\beta}_{i+1/2}[(p_w)^{\alpha}_{i+1}-(p_w)^{\alpha}_{i}]-(\lambda_w)^{\beta}_{i+1/2}[(p_w)^{\alpha}_{i}-(p_w)^{\alpha}_{i-1}]+(q_w)^{\beta}_{i}=\frac{\phi V_i}{B_w\Delta t}[(S_w)^{n+1}_{i}-(S_w)^{n}_{i}], \tag{B2}$$

where $\Delta t$ is the timestep size;

$V_i$ is the volume of cell i;

$\phi$ is porosity, i.e. pore volume per cell volume;

$(S_o)_i$ is the saturation of oil at cell i, i.e. the fraction of the pore volume occupied by oil in cell i;

$(S_w)_i$ is the saturation of water at cell i, i.e. the fraction of the pore volume occupied by water in cell i;

$B_o$ and $B_w$ are the formation volume factors (FVF) for oil and water respectively;

$(p_o)_{i-1}$, $(p_o)_i$, $(p_o)_{i+1}$ are oil pressures at cell i−1, cell i, and cell i+1 respectively;

$(p_w)_{i-1}$, $(p_w)_i$, $(p_w)_{i+1}$ are water pressures at cell i−1, cell i, and cell i+1 respectively;

$(q_o)_i$ is the rate of oil injection into cell i, and takes the value zero at most cells and takes a negative value at cells which interact with a depletion well;

$(q_w)_i$ is the rate of water injection into cell i, and typically takes a zero value except at cells which interact with an injection or depletion well;

$(x)^n$ and $(x)^{n+1}$ represent a quantity x evaluated at time indices n and n+1 respectively, where the former is known information, having been determined from previous computations, and the later is an unknown to be solved for by some computational method; and $(x)^{\alpha}$ and $(x)^{\beta}$ represent quantities which are to be evaluated at time index n or n+1 subject to user selection.

The oil transmissibility-mobility factors $(\lambda_o)_{i+½}$ and $(\lambda_o)_{i-½}$ are defined as $$(\lambda_o)_{i+1/2}=\left(\frac{Ak}{x_{i+1}-x_i}\right)(M_o)_{i+1/2}, \tag{B3}$$

$$(\lambda_o)_{i-1/2}=\left(\frac{Ak}{x_i-x_{i-1}}\right)(M_o)_{i-1/2}, \tag{B4}$$

where A is the area normal to the axis of the one-dimensional reservoir;

$(M_o)_{i+½}$ is the mobility of oil in transit between cell i and cell i+1;

$(M_o)_{i-½}$ is the mobility of oil in transit between cell i and cell i−1;

$x_k$ is the position of the $k^{th}$ cell along the one-dimensional axis.

Similar definitions apply for the water transmissibility-mobility products $(\lambda_w)_{i+½}$ and $(\lambda_w)_{i-½}$. The difference equations (B1) and (B2) above are augmented with several auxiliary relations as follows:

$$S_o+S_w=1, \tag{B5}$$

$$p_w-p_o=P_c(S_o), \tag{B6}$$

$$M_o=M_o(p_o,S_o), \tag{B7}$$

$$M_w=M_w(p_w,S_w). \tag{B8}$$

Relation (B5) follows from the definition of saturation. Capillary pressure $P_c$ which is defined as the difference in pressure between water and oil is a known function of oil saturation. Oil mobility $M_o$ is a known function of oil pressure and oil saturation. Water mobility $M_w$ is a known function of water pressure and water saturation.

Since oil mobility $M_o$ is a function of oil pressure $p_o$ and oil saturation $S_o$, and these later variables are defined at cell centers, a question arises as to the proper means of evaluating the in-transit oil mobilities $(M_o)_{i+½}$ and $(M_o)_{i-½}$. According to the midpoint weighting scheme, the in-transit oil mobility is defined to be the average of the mobilities at the two affected cells. For example, $$(M_o)_{i+½}=½(M_o)_i+½(M_o)_{i+1}, \tag{B9}$$

where $(M_o)_i$ is evaluated using the oil saturation $(S_o)_i$ and oil pressure $(p_o)_i$ prevailing at cell i, and $(M_o)_{i+1}$ is evaluated using the oil saturation $(S_o)_{i+1}$ and oil pressure $(p_o)_{i+1}$ prevailing at cell i+1. Alternatively, according to the upstream weighting scheme, the in transit mobility may be defined as the oil mobility at the upstream cell of the two affected cells, where the upstream cell is defined as the cell with higher pressure (since fluids flow from high pressure to low pressure). For example, $$(M_o)_{i+1/2}=\begin{cases}(M_o)_i, & \text{if } (p_o)_i\geq(p_o)_{i+1}\\ (M_o)_{i+1}, & \text{otherwise.}\end{cases} \tag{B10}$$

If the pressure variables and transmissibility-mobility factors in Equations (B1) and (B2) are evaluated at the new time index, i.e. $\alpha=\beta n+1$, Equations (B1) and (B2) take the form $$(\lambda_o)_{i+1/2}^{n+1}[(p_o)_{i+1}^{n+1}-(p_o)_i^{n+1}]-(\lambda_o)_{i-1/2}^{n+1}[(p_o)_i^{n+1}-(p_o)_{i-1}^{n+1}]+(q_o)_i^{n+1}=\frac{\phi V_i}{B_o\Delta t}[(S_o)_i^{n+1}-(S_o)_i^n], \quad \text{(B11)}$$

$$(\lambda_w)_{i+1/2}^{n+1}[(p_w)_{i+1}^{n+1}-(p_w)_i^{n+1}]-(\lambda_w)_{i-1/2}^{n+1}[(p_w)_i^{n+1}-(p_w)_{i-1}^{n+1}]+(q_w)_i^{n+1}=\frac{\phi V_i}{B_w\Delta t}[(S_w)_i^{n+1}-(S_w)_i^n]. \quad \text{(B12)}$$

The transmissibility-mobility factors and the phase injection rates are functions of saturation and pressure, and are evaluated at the new time level n+1. Thus, Equations (B11) and (B12) are non-linear in the unknown variables $$(p_o)_{i-1}^{n+1},(p_o)_i^{n+1},(p_o)_{i+1}^{n+1},$$
$$(p_w)_{i-1}^{n+1},(p_w)_i^{n+1},(p_w)_{i+1}^{n+1},$$
$$(S_o)_{i-1}^{n+1} \text{ and } (S_w)_{i-1}^{n+1},$$
$$(S_o)_i^{n+1} \text{ and } (S_w)_i^{n+1},$$
$$(S_o)_{i+1}^{n+1} \text{ and } (S_w)_{i+1}^{n+1}. \quad \text{(B13)}$$

Equations (B11) and (B12) may be expressed in terms of a reduced set of unknown variables using relations (B5) and (B6). For example, the variable $(S_w)_i^{n+1}$ may be replaced by $1-(S_o)_i^{n+1}$. Similarly, $(p_o)_i^{n+1}$ may be replaced by $(p_o)_i^{n+1}+P_c[(S_o)_i^{n+1}]$. Thus, Equations (B11) and (B12) may be expressed in terms of the following reduced set of unknown variables:

$$(p_o)_{i-1}^{n+1},(p_o)_i^{n+1},(p_o)_{i+1}^{n+1},\ (S_o)_{i-1}^{n+1},\ (S_o)_i^{n+1},(S_o)_{i+1}^{n+1} \quad \text{(B14)}$$

Assuming that there are N cells in the reservoir being modeled, Equations (B11) and (B12) describe a coupled non-linear system of 2N equations (two equations per cell) with 2N unknowns—each cell contributes an unknown pressure $(p_o)_i^{n+1}$ and an unknown saturation $(S_o)_i^{n+1}$. An iterative method such as Newton's method is generally required to solve such systems.

Let vector X be the vector of 2N unknowns for the system. Define a set of 2N functions $f_j$, j=0, 1, 2, 3, . . . , 2N−1, two functions per cell, as follows. A first function $f_{2i}(X)$ for cell i is defined by the expression which follows from subtracting the right-hand side of Equation (B11) from the left-hand side of Equation (B11). A second function $f_{2i+1}(X)$ for cell i is defined by the expression which follows from subtracting the right-hand side of Equation (B12) from the left-hand side of Equation (B12). Let f: $R^{2N}\rightarrow R^{2N}$ be the corresponding vector function whose component functions are the functions $f_j$. The system given by Equations (B11) and (B12) may be equivalently expressed by the equation $$f(X)=\vec{0}, \quad \text{(B15)}$$

i.e. the solution X=X* of the system given by Equations (B11) and (B12) corresponds to the zero of Equation (B15). Equation (B15) may be referred to as a fully implicit equation or a nonlinear implicit equation since none of the unknowns (B14) may be explicitly computed from known data. Thus, any method of solving equation (B15) may be referred to as a fully implicit method.

$$f(X)=\vec{0}, \quad \text{(B15)}$$

i.e. the solution X=X* of the system given by Equations (B11) and (B12) corresponds to the zero of Equation (B15). Equation (B15) may be referred to as a fully implicit equation or a nonlinear implicit equation since none of the unknowns (B14) may be explicitly computed from known data. Thus, any method of solving equation (B15) may be referred to as a fully implicit method.

Newton's method prescribes an iterative method for obtaining the solution of Equation (B15). Given a current estimate $X_k$ of the solution, the function $f$ is linearized in the vicinity of this current estimate:

$$Y=df(X_k)\cdot(X-X_k)+f(X_k), \quad \text{(B16)}$$

where $df(X_k)$ represents the Jacobian matrix of the function $f$ evaluated at $X=X_k$, and $f(X_k)$ represents the evaluation of function $f$ at the current estimate. The next estimate $X_{k+1}$ of the solution is obtained by setting vector Y equal to zero and solving for argument X. Thus, the next estimate $X_{k+1}$ satisfies the matrix equation $$df(X_k)\cdot X_{k+1}=df(X_k)\cdot X_k-f(X_k). \quad \text{(B17)}$$

By solving Equation (B17) for successively increasing values of the index k, a sequence of estimates $X_o$, $X_1$, $X_2$, . . . , $X_k$, . . . is obtained which converge to the solution of the nonlinear system (B15).

Equation (B17) is referred to herein as an implicit matrix equation. A linear equation solver is used to solve the implicit matrix equation (B17). The right-hand side vector $df(X_k)\cdot X_k-f(X_k)$ and the Jacobian matrix $df(X_k)$ are supplied as input data to the linear solver. The linear solver returns the solution vector $X_{k+1}$ of the implicit matrix equation (B17). The computational effort of a Newton's method solution of the nonlinear implicit equation (B15) depends on (a) the number of Newton iterations to achieve convergence of the sequence $X_k$, (b) the average computational effort expended by the linear solver to solve the implicit matrix equation (B17), and (c) the computational effort required to update the matrix equation as improved solutions are obtained. While most of the computational effort per Newton iteration is associated with solving the matrix equation, the effort required to update the matrix equation is also significant. Thus, any improvement in the computational efficiency of the linear equation solver will have a corresponding effect on the efficiency of the Newton's method solution.

As described above, the nonlinear implicit equation (B15) arises from the choices α=βn+1 in Equations (B1) and (B2) above. Another plausible set of choices is given by α=n+1 and β=n , whereupon Equations (B1) and (B2) take the form $$(\lambda_o)_{i+1/2}^{n}[(p_o)_{i+1}^{n+1}-(p_o)_i^{n+1}]-(\lambda_o)_{i-1/2}^{n}[(p_o)_i^{n+1}-(p_o)_{i-1}^{n+1}]+(q_o)_i^{n}=\frac{\phi V_i}{B_o\Delta t}[(S_o)_i^{n+1}-(S_o)_i^n], \quad \text{(B18)}$$

$$(\lambda_w)_{i+1/2}^{n}[(p_w)_{i+1}^{n+1}-(p_w)_i^{n+1}]-(\lambda_w)_{i-1/2}^{n}[(p_w)_i^{n+1}-(p_w)_{i-1}^{n+1}]+(q_w)_i^{n}=\frac{\phi V_i}{B_w\Delta t}[(S_w)_i^{n+1}-(S_w)_i^n]. \quad \text{(B19)}$$

The saturations and pressures at time-index n comprise known data (having been determined from previous computations). Thus, the transmissibility-mobility functions evaluated at time-index n comprise known constants. Equations (B18) and (B19) are therefore linear in the unknown variables $$(p_o)_{i-1}^{n+1},\ (p_o)_i^{n+1},\ (p_o)_{i+1}^{n+1},$$
$$(p_w)_{i-1}^{n+1},\ (p_w)_i^{n+1},\ (p_w)_{i+1}^{n+1},$$
$$(S_o)_i^{n+1} \text{ and } (S_w)_i^{n+1}. \quad \text{(B20)}$$

One method for solving the linear system of Equations (B18) and (B19), i.e. the so called Implicit-Pressure Explicit-Saturation (IMPES) method, is motivated by the following reduction of Equations (B18) and (B19). Since the saturation variables obey relation (B5), the Equations (B18) and (B19) may be combined so as to eliminate the unknown saturation variables. In particular, Equation (B18) may be multiplied by the oil formation volume factor $B_o$, and Equation (B19) may be multiplied by the water formation volume factor $B_w$. The resulting equations may be added together to generate the following linear equation involving only the pressure unknowns:

$$B_o(\lambda_o)_{i+\frac{1}{2}}^n[(p_o)_{i+1}^{n+1}-(p_o)_i^{n+1}]-B_o(\lambda_o)_{i-\frac{1}{2}}^n[(p_o)_i^{n+1}-(p_o)_{i-1}^{n+1}]$$
$$+B_w(\lambda_w)_{i+\frac{1}{2}}^n[(p_w)_{i+1}^{n+1}-(p_w)_i^{n+1}]-B_w(\lambda_w)_{i-\frac{1}{2}}^n[(p_w)_i^{n+1}-(p_w)_{i-1}^{n+1}]$$
$$+B_o(q_o)_i^n+B_w(q_w)_i^n=0. \quad \text{(B21)}$$

Equation (B21) is referred to herein as an IMPES pressure equation. The capillary pressure relation (B6) may be used to eliminate the water pressure unknowns under the assumption that capillary pressure does not change during the timestep:

$$(p_w)_j^{n+1}=(p_o)_j^{n+1}+P_c[(S_o)_j^n], \quad \text{(B22)}$$

where j represents an arbitrary cell index. When Equation (B21) is written for all N cells in the reservoir, the ensuing system, herein referred to as the IMPES pressure system, has N equations and N unknowns—one unknown pressure $(p_o)_j^{n+1}$ per cell. Because the IMPES pressure system is linear and has fewer equations and unknowns it may be solved much faster than the fully implicit system (B15).

Again a linear equation solver may be invoked to solve the IMPES pressure system. The solution vector $p^{n+1}$ of the IMPES pressure system specifies the pressure $(p_o)_i^{n+1}$ at every cell in the reservoir. The unknown saturations $(S_o)_i^{n+1}$ and $(S_w)_i^{n+1}$ in Equations (B18) and (B19) may be determined by substituting the pressure solution values $(p_o)_j^{n+1}$ into the left-hand sides of Equations (B18) and (B19). Since the saturations $(S_o)_i^n$ and $(S_w)_i^n$ are known from previous computations, the unknown saturations $(S_o)_i^{n+1}$ and $(S_w)_i^{n+1}$ may be computed explicitly. Thus, the IMPES procedure involves two steps: a first step in which pressures are computed implicitly as the solution of a linear system; and a second step in which saturations are computed explicitly based on the pressure solution.

The example of a one-dimensional model discussed above represents a greatly simplified description of a complicated physical situation. More realistic models involve (a) a two-dimensional or three-dimensional array of cells, (b) more than two conserved species, (c) more than two phases, (d) compressible fluids and/or rock substrate, (e) non-uniform cell geometry and spacing, etc. In addition, the difference equations of the reservoir model may not necessarily arise from a fluid volume balance. In other approaches, difference equations may be obtained by performing, e.g., mass or energy balances. While pressure is quite often one of the variables being solved for at each cell, the remaining variables need not necessarily be saturations. For example, in other formulations, the remaining variables may be mole fractions, masses, or other quantities.

Given a reservoir with M conserved species, a conservation law may be invoked to write a set of M difference equations describing the physical behavior of each of the conserved species at a generic cell i. (The use of a single index i to denote a generic cell does not necessarily imply that the reservoir model is one-dimensional.) The set of equations may generally be expressed in terms of the pressure $P_b$ of some base species (often oil), and (M−1) complementary variables such as saturations, mole fractions, masses, etc. These complementary variables will be referred to herein as generalized saturations.

The discussion of the fully implicit method and the IMPES method presented above generalizes to more realistic models. The M difference equations for the generic cell i generally include functions such as mobility, formation volume factor, pore volume, injection rate etc., which depend on pressure and/or the generalized saturations (i.e. complementary variables). The fully implicit equations result from evaluating such functions at the new time index n+1. The fully implicit equations are generally non-linear, and thus, require an iterative method such as Newton's method for their solution.

The IMPES formulation starts from evaluating functions of pressure and/or the complementary variables at the old time index n. Thus, the M difference equations particularize to a set of linear equations in the unknown pressures and unknown generalized saturations. An auxiliary relation analogous to relation (B5) may be used to combine the set of linear equations into a single equation which involves only the pressure unknowns. This single equation is commonly referred to as the IMPES pressure equation. The IMPES pressure equation may be solved by calling a linear equation solver. The pressure solution is then substituted into the original set of linear equations, and the generalized saturations are computed explicitly.

Both the fully implicit method and the IMPES method aim at generating values for the base pressure and the generalized saturations at the new time index n+1 for each cell in the reservoir. However, because the IMPES method is less stable than the fully implicit method (FIM), the timestep $\Delta t_{IMPES}$ used in the IMPES method is generally significantly smaller than the timestep $\Delta t_{FIM}$ used in the fully implicit method. While the single-timestep computational effort $CE_{IMPES}$ of IMPES is much smaller than the single-timestep computational effort $CE_{FIM}$ of the fully implicit method, it is quite often the case that the ratio $$\frac{\Delta t_{FIM}}{\Delta t_{IMPES}}$$

of timestep sizes is larger than the ratio $$\frac{CE_{FIM}}{CE_{IMPES}}$$

of computational efforts. Thus, any advantage gained by the single-timestep efficiency of the IMPES method is counteracted by the necessity of performing a large number of IMPES timesteps to cover a timestep of the fully implicit method.

The IMPES method is one method in a general class of methods commonly referred to as sequential methods. A sequential method involves a two-step procedure: a first step in which unknown pressures are determined, and a second step in which comlementary unknowns (i.e. unknowns other than pressure) are determined using the pressure solution obtained in the first step.

Another sequential method, commonly referred to as the total velocity sequential semi-implicit (TVSSI) method has received significant use since it was originally developed by Spillette et al. circa 1970. The TVSSI method is described in the following paper by Spillette, A. G., Hillestad, J. G., and Stone, H. L.: "A High-Stability Sequential Solution Approach to Reservoir Simulation," SPE 4542 presented at the 1973 SPE Annual Meeting, Las Vegas, September 30–October 3. This paper is hereby incorporated by reference.

Similar to the IMPES method, the TVSSI method has the advantage of reduced computational effort per timestep as compared to the fully implicit method. However, the TVSSI method is far more stable than the IMPES method. The increased stability implies that the timestep $\Delta t_{TVSSI}$ of the TVSSI method may be significantly larger than the IMPES timestep $\Delta t_{IMPES}$. The TVSSI method comprises two major steps: (i) solving the IMPES pressure system; and (ii) solving a set of coupled saturation equations for the generalized saturations. Since the IMPES pressure equation involves a single unknown (i.e. pressure) at each cell, step (i) requires significantly less work than solving the set of fully implicit equations. In addition, since the set of coupled saturation equations does not have the elliptic nature of the IMPES pressure equation or the set of fully implicit equations, the saturation solution converges rapidly. Overall, the single-timestep computational effort $CE_{TVSSI}$ for the TVSSI method is typically a half to a fifth that of the fully implicit computations.

The TVSSI method is not as stable as the fully implicit method. In some problems, the ratio $$\frac{\Delta t_{FIM}}{\Delta t_{TVSSI}}$$

of timestep sizes is larger than the ratio $$\frac{CE_{FIM}}{CE_{TVSSI}}$$

of computational efforts. In other words, the single timestep computational efficiency of the TVSSI method relative to the fully implicit method is more than offset by the necessity of performing multiple timesteps of the TVSSI method to cover a timestep of the fully implicit method.

Overall, the fully implicit method seems to be more desirable than the TVSSI method, in part because it is more trouble-free. However, the total velocity equations contain a certain power that enables the success, albeit not universal, of the TVSSI method. This power has yet to be fully appreciated and harnessed. Thus, there exists a need for a reservoir simulation method which may more effectively capture this power inherent in the total velocity equations.

One prior-art method used to lower the cost of reservoir simulations is the so called adaptive implicit method (AIM). The adaptive implicit method is based on the recognition that the implicit formulation is required at only a fraction of the cells in the reservoir model. If the implicit formulation can be applied only where it is needed, with the IMPES formulation being used at the remaining cells, significant reductions in computational effort may be obtained. The adaptive implicit method determines dynamically which cells require implicit formulation. As the simulation progresses in time, a particular cell may switch back and forth between IMPES formulation and implicit formulation.

In a related prior-art method, referred to as static variable implicitness, the assignment of IMPES or implicit formulation to each cell in the reservoir remains fixed through the simulation.

Although the adaptive implicit method and variable implicit method are computationally more efficient than the fully implicit method, they are still significantly time consuming. Thus, there exists a need for improved methods for performing adaptive and variable implicit reservoir simulations.

SUMMARY OF THE INVENTION

The present invention comprises a method for performing reservoir simulation by solving a mixed implicit-IMPES matrix (MIIM) equation. The MIIM equation arises from a Newton iteration of a variable implicit reservoir model. The variable implicit reservoir model comprises a plurality of cells including both implicit cells and IMPES cells. The MIIM equation includes a scalar IMPES equation for each of the IMPES cells and a set of implicit equations for each of the implicit cells.

In one embodiment, the method for performing reservoir simulation comprises: (a) constructing a global IMPES pressure matrix equation from the MIIM equation; (b) determining coefficients for a set of saturation equations at the implicit cells by using a total velocity constraint at the implicit cells; (c) solving the global IMPES pressure matrix equation for pressure changes; (d) computing first residuals at the implicit cells in response to the pressure changes; (e) solving the set of saturation equations (formed from the coefficients and first residuals) for saturation changes at the implicit cells; (f) computing second residuals at the implicit cells and at a subset of the IMPES cells that are in flow communication with any of the implicit cells in response to the saturation changes. Steps (b) through (f) may be repeated until the second residuals satisfy a convergence condition. A final solution estimate may be computed for the MIIM equation from the pressures changes and the saturation changes after the convergence condition is satisfied. The final solution estimate may be used by a reservoir simulator to determine behavior of the reservoir model at a future discrete time value.

The global IMPES pressure matrix equation may be constructed from the MIIM equation by (i) manipulating the set of implicit equations at each implicit cell to generate a corresponding IMPES pressure equation, and (ii) concatenating the IMPES pressure equations for the IMPES cells and the IMPES pressure equations for the implicit cells. Note the IMPES pressure equations for the IMPES cells are provided by the MIIM equations.

In a second embodiment, the method for performing reservoir simulation comprises: (a) constructing a global IMPES pressure equation from the MIIM equation; (b) solving the global IMPES pressure equation for pressure changes; (c) computing first residuals at the implicit cells in response to the pressure changes; (d) determining improved saturations and improved pressures by performing one or more iterations with a selected preconditioner at the implicit cells; and (e) computing second residuals at the implicit cells and at a subset of the IMPES cells that are in flow communication with any of the implicit cells in response to the improved saturations and improved pressures. Steps (b) through (e) may be repeated until a convergence condition based on the second residuals is satisfied. A final solution estimate for the MIIM equation may be computed from the pressure changes, improved saturations and improved pressures after the convergence condition is satisfied. The final solution estimate may be used to determine behavior of the reservoir model at a future discrete time value.

In a third embodiment, the method for performing reservoir simulation comprises: (a) constructing a global IMPES pressure equation from the MIIM equation; (b) solving the global IMPES pressure equation for pressure changes; (c) computing first residuals at the implicit cells in response to the pressure changes; (d) solving an implicit system comprising the set of implicit equations associated with each of the implicit cells for improved saturations and improved pressures at the implicit cells using the first residuals at the implicit cells; and (e) computing second residuals for a subset of the IMPES cells which are in flow communication with any of the implicit cells. Steps (b) through (e) may be iterated until a convergence condition is satisfied based on the second residuals. The final solution estimate for the MIIM equation may be computed based on the improved saturations and improved pressures after the convergence condition is satisfied. In solving the implicit system, cell pressures for fringe IMPES cells (i.e. the IMPES cells which are in flow communication with any implicit cell) are held fixed at those values determined in the pressure solution of step (b).

BRIEF DESCRIPTION OF THE DRAWINGS

A better understanding of the present invention can be obtained when the following detailed description of the preferred embodiments is considered in conjunction with the following drawings, in which.

Figure 1:
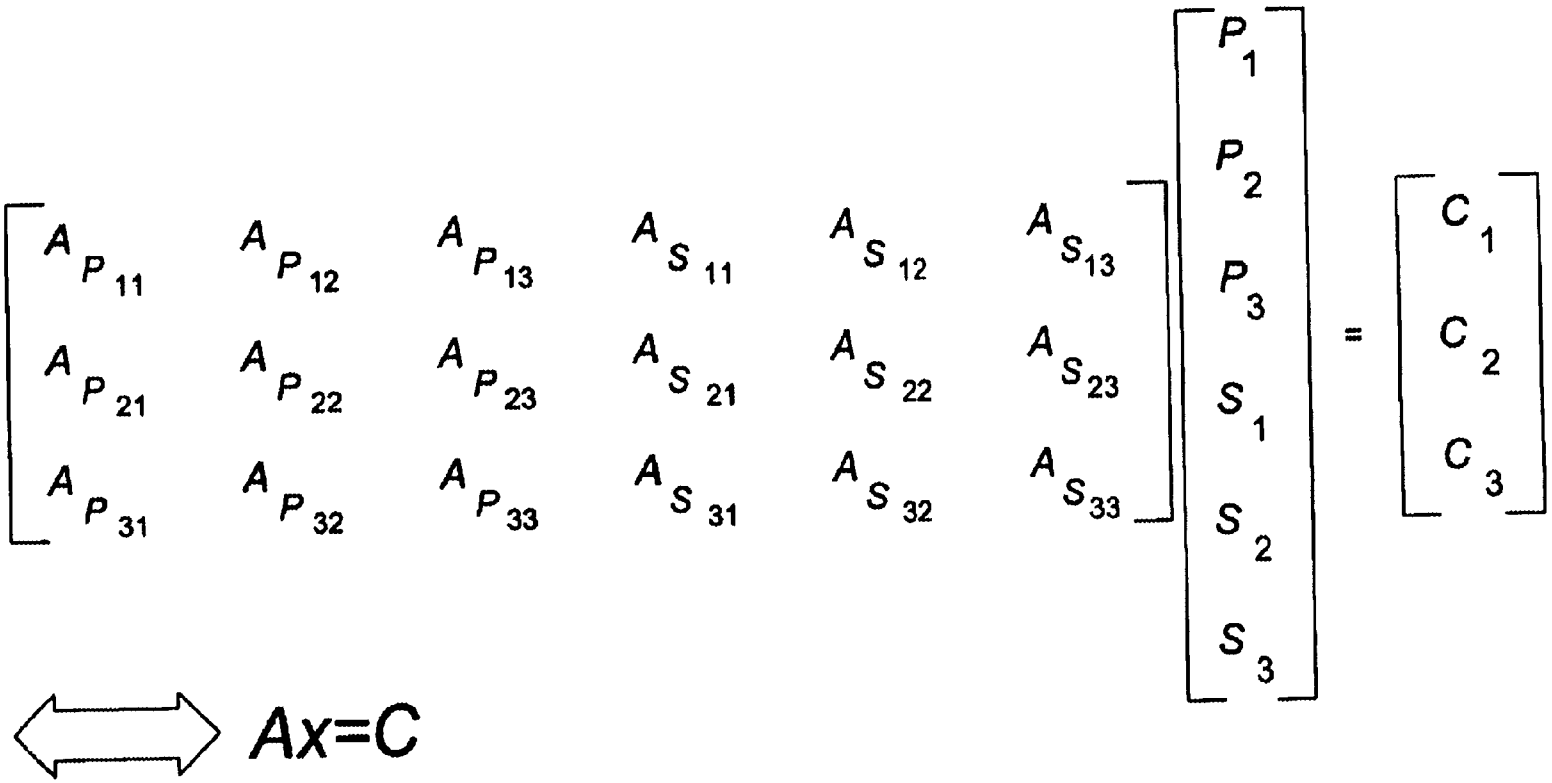
Fig. 1 (Prior Art)
FIG. 1 illustrates the structure of an implicit matrix equation used in reservoir simulation.

While the invention is susceptible to various modifications and alternative forms, specific embodiments thereof are shown by way of example in the drawings and will herein be described in detail. It should be understood, however, that the drawings and detailed description thereto are not intended to limit the invention to the particular forms disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

1. An Implicit Linear Equation Solver

The present invention comprises a method for solving an implicit linear equation Ax=C which arises from a Newton iteration of the filly implicit equations. Equation (B17) above is an example of an implicit linear equation. Matrix A and vector C are given, and vector x is to be determined. The vector unknown x has the form $$x = \begin{bmatrix} P \\ S \end{bmatrix},$$

where P is a vector of cell pressures (one pressure per cell) and S is a vector of cell saturations (M−1 saturations per cell for simulations with M conserved species). Given a current estimate $$x^n = \begin{bmatrix} P^n \\ S^n \end{bmatrix}$$

for the solution of the implicit linear equation Ax=C, the linear solver method of the present invention may be described as follows:

(A) Compute an updated pressure vector $P^{n+1/3}$ using an IMPES pressure equation which is derived from the implicit matrix equation;

(B) Solve for an updated saturation vector $S^{n+2/3}$ in equations developed using a total velocity conservation principle; and (C) Supply the vector $$\begin{bmatrix} P^{n+\frac{1}{3}} \\ S^{n+\frac{2}{3}} \end{bmatrix}$$

comprising the IMPES pressure $P^{n+1/3}$ and the updated saturation $S^{n+2/3}$ to a solution accelerator such as ORTHOMIN or GMRES.

The updated solution estimate $$x^{n+1} = \begin{bmatrix} P^{n+1} \\ S^{n+1} \end{bmatrix}$$

returned by the accelerator forms the basis for the next iteration of steps (A) through (C). Steps (A) through (C) are repeated until convergence is attained.

Let $$x^{n+\frac{1}{3}} = \begin{bmatrix} P^{n+\frac{1}{3}} \\ S^n \end{bmatrix}$$

represent the intermediate solution estimate after the IMPES pressure vector $P^{n+1/3}$ is computed. Define vector unknown $$x^{n+\frac{2}{3}} = \begin{bmatrix} P^{n+\frac{2}{3}} \\ S^{n+\frac{2}{3}} \end{bmatrix}$$

which includes unknown saturation vector $S^{n+2/3}$. (It is noted that the pressure vector $P^{n+2/3}$ will not be computed, but its presence here assists in formulation of the requisite equations). Observe that $$Ax^{n+\frac{2}{3}} = b \Leftrightarrow A\left(x^{n+\frac{2}{3}} - x^{n+\frac{1}{3}}\right) = -Ax^{n+\frac{1}{3}} + b \tag{1.1}$$

-continued $$\Leftrightarrow A\begin{bmatrix} P^{n+\frac{2}{3}} - P^{n+\frac{1}{3}} \\ S^{n+\frac{2}{3}} - S^{n} \end{bmatrix} = -A\begin{bmatrix} P^{n+\frac{1}{3}} \\ S^{n} \end{bmatrix} + b. \tag{1.2}$$

The pressure change $P^{n+2/3}-P^{n+1/3}$ and the saturation change $S^{n+2/3}-S^{n+1/3}$ induces a changes in the flow between cells. The total velocity equations are used to eliminate the effect of the pressure change $P^{n+2/3}-P^{n+1/3}$ on the change in flow. The resulting equations may be solved for the updated saturation $S^{n+2/3}$.

The linear solver method of the present invention is similar to the combinative method in that it involves a strategy of solving for pressure first and then for variables other than pressure.

Each outer iteration of the linear solver method is relatively inexpensive, and success of the method hinges on how many outer iterations are needed. The linear solver method is particularly well suited for use with the adaptive implicit method (AIM), since the natural way to perform AIM is to begin by solving the global set of IMPES equations.

1.1 Some Theoretical Observations

The linear solver method of the present invention exploits beneficial properties of the total velocity equations within a linear equation solver. The linear equation solver may be used to solve an implicit linear equation Ax=C. (When Newton's method is applied to the fully implicit equations, a whole series of such equations is generated, one equation per Newton iteration.) The following theoretical observations provide motivation for the linear solver method according to the present invention. The flow velocity $v_v$ between two cells is given by the expression $$v_v=\lambda_v\Delta\Phi_v, \tag{1.1.1}$$

where index v denotes a particular phase such as oil, water or gas, $\lambda_v$ is the transmissibility-mobility product for phase v, and $\Delta\phi_v$ is the potential difference for phase v between the two cells. Let the subscript b indicate the base phase, i.e. the phase whose pressure is solved for in the IMPES pressure equation. Eq. (1.1.1) may be rewritten in a form containing two spatial differences—one that depends on the base pressure and one that depends on capillary pressure, i.e. the difference in pressure between phase v and the base phase b:

$$v_v=\lambda_v\Delta\Phi_b+\lambda_v\Delta(\Phi_v-\Phi_b). \tag{1.1.2}$$

Summing the phase velocities over all phases gives an expression for total velocity $v_T$ as follows:

$$v_T = \lambda_T\Delta\Phi_b + \sum_\mu \lambda_\mu\Delta(\Phi_\mu - \Phi_b). \tag{1.1.3}$$

The subscript T denotes a quantity that is summed over all phases v. It can be shown that continuity constraints force the total velocity to vary substantially less than individual phase velocities. In the extreme case of one-dimensional incompressible flow, the total velocity does not vary at all spatially.

By solving for $\Delta\Phi_b$ Eq. (1.1.3), and substituting the resultant expression into Eq. (1.1.2), the flow velocity may be expressed as $$v_v = \frac{\lambda_v}{\lambda_T}\left[v_T + \sum_\mu \lambda_\mu\Delta(\Phi_v - \Phi_\mu)\right]. \tag{1.1.4}$$

In anticipation of an iterative method, Eq. (1.1.1) is rewritten in a linearized form:

$$\delta v_v^k=\delta\lambda_v^k\Delta\Phi_v^k+\lambda_v^k\delta\Delta\Phi_v^k, \tag{1.1.5}$$

where the superscript k is the iteration number and $\delta x^k$ denotes the change in quantity x between iterations k and k+1. Similarly, Eq. (1.1.4) may be linearized as $$\delta v_v^k = \delta\left(\frac{\lambda_v^k}{\lambda_T^k}\right)\left[v_T^k + \sum_\mu \lambda_\mu^k\Delta(\Phi_v^k - \Phi_\mu^k)\right] + \frac{\lambda_v^k}{\lambda_T^k}\left[\delta v_T^k + \sum_\mu \delta\lambda_\mu^k\Delta(\Phi_v^k - \Phi_\mu^k) + \sum_\mu \lambda_\mu^k\delta\Delta(\Phi_v^k - \Phi_\mu^k)\right], \tag{1.1.6}$$

where $$v_T^k = \lambda_T^k\Delta\Phi_b^k + \sum_\mu \lambda_\mu^k\Delta(\Phi_\mu^k - \Phi_b^k), \text{ and} \tag{1.1.7}$$

$$\delta v_T^k = \delta\lambda_T^k\Delta\Phi_b^k + \lambda_T^k\delta\Delta\Phi_b^k + \sum_\mu \delta\lambda_\mu^k\Delta(\Phi_\mu^k - \Phi_b^k) + \sum_\mu \lambda_\mu^k\delta\Delta(\Phi_\mu^k - \Phi_b^k) \tag{1.1.8}$$

Finally, an updated phase velocity may be defined as $$v_v^{k+1}=v_v^k+\delta v_v^k, \tag{1.1.9}$$

where $$v_v^k=\lambda_v^k\Delta\Phi_v^k. \tag{1.1.10}$$

Eqs. (1.1.5) and (1.1.6) are exactly equivalent. If Eqs. (1.1.7) and (1.1.8) are substituted into Eq. (1.1.6), and all possible cancellations are performed, Eq. (1.1.6) reduces to Eq. (1.1.5). It is noted that Eq. (1.1.6) includes only one term, i.e. $\delta v_T^k$, which depends on the pressure solution $\Phi_b^{k+1}$. As a result, given an estimate for $\delta v_T^k$, Eqs. (1.1.6) and (1.1.9) form the basis of a set of equations which involve only saturation variables $S_v$. It is noted that the transmissibility-mobility products $\lambda_v$ and the capillary pressures $P_{cv}=\Phi_v^k-\Phi_b^k$ are functions of the saturation variables.

1.2 Generating Total Velocity Sequential Equations

This section describes the computational steps in generating the total velocity sequential equations from the implicit matrix equation Ax=C, where A is a given matrix, C is a given vector, and x is a vector unknown comprising cell pressures (one pressure per cell) and generalized saturations (M−1 generalized saturations per cell in a reservoir model with M conserved species).

FIG. 1 illustrates the structure of the implicit matrix equation for a reservoir with three cells. However, the following discussion generalizes to any number N of cells. The matrix A on the left-hand side of the implicit matrix equation is an array of submatrices (also referred to herein as blocks) with N block-rows and 2N block-columns. Each of the submatrices $A_{Pij}$ of matrix A has M rows and one column, where M is the number of conserved species. Each of the submatrices $A_{Sij}$ of matrix A has M rows and M−1 columns. Thus, matrix A has NM rows and NM columns.

The vector unknown x comprises scalar pressures $P_i$ and generalized saturation subvectors $S_i$. The scalar pressure $P_i$ is the base pressure at cell i, i.e. the pressure of a predetermined phase at cell i. The generalized saturation subvector Si comprises a set of (M−1) generalized saturation variables at cell i. Therefore, vector unknown x has dimension MN. Vector c, on the right-hand side of the matrix equation, comprises N subvectors $C_i$. Each subvector $C_i$ comprises M known constants. Thus vector C has dimension MN.

Each cell of the reservoir contributes M scalar equations to the matrix equation. Each block-row of the matrix equation summarizes the M scalar equations which are contributed by a corresponding cell. For example, the $i^{th}$ block row of the matrix equation, i.e.

$$\sum_{j=1}^{N} (A_{Pij}P_j + A_{Sij}S_j) = C_i, \tag{1.2.0}$$

summarizes the M scalar equations which are contributed by cell i. Equation (1.2.0) may be equivalently expressed in the form $$[\,A_{Pii} \quad A_{Sii}\,]\begin{bmatrix} P_i \\ S_i \end{bmatrix} + \sum_{j\neq i} [\,A_{Pij} \quad A_{Sij}\,]\begin{bmatrix} P_j \\ S_j \end{bmatrix} = C_i, \tag{1.2.1}$$

which distinguishes (a) the summation term j=i which involves the pressure $P_i$ and saturation vector $S_i$ for cell i, and (b) the remaining summation terms j≠i which involve pressures and saturations at other cells. It is noted that the submatrices $A_{Pij}$ and $A_{Sij}$ will be zero except for those cells j which are in contact with cell i.

Each diagonal pressure submatrix $A_{Pii}$ may be expressed as the sum of a pressure capacitance submatrix $C_{Pii}$ and a pressure flow submatrix $F_{Pii}$:

$$A_{Pii}=C_{Pii}+F_{Pii}.$$

Similarly, each diagonal saturation submatrix $A_{Sii}$ may be expressed as the sum of a saturation capacitance submatrix $C_{Sii}$ and a saturation flow submatrix $F_{Sii}$:

$$A_{Sii}=C_{Sii}+F_{Sii}.$$

Off-diagonal pressure submatrices $A_{Pij}$ and saturation submatrices $A_{Sij}$ relate entirely to flow. Thus, each off-diagonal pressure submatrix $A_{Pij}$, may be equated to a corresponding pressure flow submatrix $F_{Pij}$, and each off-diagonal saturation submatrix $A_{Sij}$ may be equated to a corresponding saturation flow submatrix $F_{Sij}$.

Equation (1.2.1) may be rewritten in a form which distinguishes between capacitance and flow contributions:

$$[\,C_{Pii} + F_{Pii} \quad C_{Sii} + F_{Sii}\,]\begin{bmatrix} P_i \\ S_i \end{bmatrix} + \sum_{j\neq i} [\,F_{Pij} \quad F_{Sij}\,]\begin{bmatrix} P_j \\ S_j \end{bmatrix} = C_i. \tag{1.2.2}$$

The flow submatrices obey the following relations:

$$F_{Pii} = -\sum_{j\neq i} F_{Pji} = -\sum_{j\neq i} A_{Pji}, \tag{1.2.3}$$

-continued $$F_{Sii} = -\sum_{j\neq i} F_{Sji} = -\sum_{j\neq i} A_{Sji}. \tag{1.2.4}$$

Thus, the pressure flow submatrix $F_{Pii}$ may be computed by adding the off-diagonal pressure submatrices $A_{Pji}$ in the $i^{th}$ block-column of matrix A, and negating the resultant sum. Similarly, the saturation flow submatrix $F_{Sii}$ may be computed by adding the off-diagonal saturation submatrices $A_{Sji}$ in the $i^{th}$ block-column of matrix A, and negating the resultant sum.

The Volume Balance Equation

The volume balance equation combines the M scalar equations at each cell into a single scalar equation in such a way that the saturation capacitance disappears. This is accomplished by determining multipliers as follows. The first step in the determination of multipliers is to determine the saturation capacitance coefficients according to the relation $$C_{Sii} = A_{Sii} - F_{Sii} = A_{Sii} + \sum_{\substack{j=1 \\ j\neq i}}^{N} A_{Sji}. \tag{1.2.5}$$

An M×1 vector $M_i$ is determined by solving the linear system given by $$C_{SiiT}M_i=0, \tag{1.2.6a}$$

$$e^TM_i=1, \tag{1.2.6b}$$

where the superscript T denotes the matrix transpose operation, and e is a vector consisting entirely of ones. The components of vector $M_i$ are the multipliers which are used to combine the M scalar equations at cell i. Since Equation (1.2.6a) comprises M−1 scalar equations in M unknowns, an additional constraint is needed to obtain unique solutions for the multipliers. Eq. (1.2.6b) is one possibility among many. Another possibility is to specify one of the multipliers, reducing the number of unknowns by one and thereby reducing the computational requirement.

The volume balance equation is obtained by premultiplying Eq. (1.2.1) by $M_i^T$. The resulting equation is $$[\,B_{Pii} \quad B_{Sii}\,]\begin{bmatrix} P_i \\ S_i \end{bmatrix} + \sum_{j\neq i} [\,B_{Pij} \quad B_{Sij}\,]\begin{bmatrix} P_j \\ S_j \end{bmatrix} = B_{Ci}, \tag{1.2.7}$$

where $$B_{Pii}=M_i^TA_{Pii}, \tag{1.2.8}$$

$$B_{Sii}=M_i^TA_{Sii}=M_i^TF_{Sii}, \tag{1.2.9}$$

$$B_{Pij}=M_i^TA_{Pij}, \tag{1.2.10}$$

$$B_{Sij}=M_i^TA_{Sij}, \tag{1.2.11}$$

$$B_{Ci}=M_i^TC_i. \tag{1.2.12}$$

The IMPES pressure equation may be obtained from Equation (1.2.7) by evaluating pressures at intermediate iteration level (n+⅓ and saturations at the old iteration level n. Thus, the IMPES pressure equation is as follows:

$$B_{Pii}P_i^{n+1/3}+\sum_{j\neq i}B_{Pij}P_j^{n+1/3}=B_{Ci}-B_{Sii}S_i^n-\sum_{j\neq i}B_{Sij}S_j^n. \quad (1.2.13)$$

The Velocity Equation

In one prior art method, i.e. the total velocity sequential method, pressures and saturations are computed according to the following strategy: (a) pressures are computed using Eq. (1.2.13); (b) total velocities are computed based on these pressures; and (c) saturations are computed while holding fixed the total velocities.

Since velocity relates to flow between connections, rather than conservation at a cell, the equations of the present invention require a different construction. Let $F^{ij}$ be the vector of flows from cell i to cell j defined by $$F^{ij}=F^{ij,0}F_{Pi}{}^{ij}P_i+F_{Pj}{}^{ij}P_j+F_{Si}{}^{ij}S_i+F_{Sj}{}^{ij}S_j, \quad (1.2.14)$$

where the M components of $F^{ij}$ represent the flows of each of the conserved species from cell i to cell j; $F_{Pi}{}^{ij}$ and $F_{Pj}{}^{ij}$ are M×1 vectors; and $F_{Si}{}^{ij}$ and $F_{Sj}{}^{ij}$ are M×(M−1) matrices. These terms can be extracted from the original matrix equation, as follows. The two off-diagonal (i.e., j) terms are $$F_{Pj}{}^{ij}=A_{Pij}, \quad (1.2.15)$$

$$F_{Si}{}^{ij}=A_{Sij}. \quad (1.2.16)$$

The corresponding flows from cell j to cell i obey the relation $$F^{ij}=-F^{ji}. \quad (1.2.17)$$

As a result, the diagonal (i.e., i) terms can be obtained from the equations at the connected cells, leading to $$F_{Pi}{}^{ij}=-A_{Pji}, \quad (1.2.18)$$

$$F_{Si}{}^{ij}=-A_{Sji}. \quad (1.2.19)$$

The view from cell i of the total volumetric flow from cell i to cell j is given by $$F_T{}^{ij}=M_i^TF^{ij}. \quad (1.2.20)$$

The view from cell j of the total flow from cell j to cell i, in addition to having an opposite sign, has a different magnitude because its vector of multipliers is different, i.e.

$$F_T{}^{ji}=-M_j^TF^{ij}, \quad (1.2.21)$$

The total flow, as viewed from cell i, is given by the following expression, which is obtained by multiplying (1.2.14) by $M_i^T$.

$$F_T{}^{ij}=F_T{}^{ij,0}+F_{TPi}{}^{ij}P_i+F_{TPj}{}^{ij}+F_{TSi}{}^{ij}S_i+F_{TSj}{}^{ij}S_j, \quad (1.2.22)$$

where $$F_T{}^{ij,0}=M_i^TF^{ij,0},$$

$$F_{TPi}{}^{ij}M_i^TF_{Pi}{}^{ij},$$

$$F_{TPj}{}^{ij}=M_i^TF_{Pj}{}^{ij},$$

$$F_{TSi}{}^{ij}=M_i^TF_{Si}{}^{ij},$$

$$F_{TSj}{}^{ij}=M_i^TF_{Sj}{}^{ij}.$$

By solving the IMPES pressure equation (1.2.13), pressures $P_i^{n+1/3}$ at the intermediate iteration level n+⅓ are obtained. These pressures may be substituted into Equation (1.2.22) giving an expression for the total velocity after the IMPES pressure solution:

$$F_T{}^{ij}=F_T{}^{ij,0}+F_{TPi}{}^{ij}P_i^{n+1/3}+F_{TPj}{}^{ij}P_j^{n+1/3}+F_{TSi}{}^{ij}S_i^n+F_{TSj}{}^{ij}S_j^n. \quad (1.2.23)$$

In the discussion to follow, a set of equations will be developed which enable the computation of a new set of saturations $S_i^{n+2/3}$. Let $P_i^{ij}$ be the pressures which correspond to the new saturations and are used to compute flow from cell i to cell j. (These pressures will not be computed, however it is convenient to include them here to aid the development of the requisite equations.) The total velocity corresponding to the new pressures and saturations is given by $$\hat{F}_T{}^{ij}=F_T{}^{ij,0}+F_{TPi}{}^{ij}P_i^{ij}+F_{TPj}{}^{ij}P_j^{ij}+F_{TSi}{}^{ij}S_i^{n+2/3}+F_{TSj}{}^{ij}S_j^{n+2/3}. \quad (1.2.24)$$

Thus, cell i's view of the change in total velocity is obtained by subtracting Equation (1.2.23) from Equation (1.2.24):

$$\delta F_T{}^{ij}=F_{TPi}{}^{ij}(P_i^{ij}-P_i^{n+1/3})+F_{TPj}{}^{ij}(P_j^{ij}-P_j^{n+1/3})+F_{TSi}{}^{ij}(S_i^{n+2/3}-S_i^n)+F_{TSj}{}^{ij}(S_j^{n+2/3}-S_j^n). \quad (1.2.25)$$

This total velocity change $\delta F_T{}^{ij}$ is set equal to zero, yielding $$F_{TPi}{}^{ij}(P_i^{ij}-P_i^{n+1/3})+F_{TPj}{}^{ij}(P_j^{ij}-P_j^{n+1/3})+F_{TSi}{}^{ij}(S_i^{n+2/3}-S_i^n)+F_{TSj}{}^{ij}(S_j^{n+2/3}-S_j^n)=0 \quad (1.2.26)$$

Note that the pressure at cell i in (1.2.26), $P_i^{ij}$, may vary with j.

Writing the balance equation (1.2.2) in terms of the desired iteration levels and rearranging yields $$\sum_{j\neq i}F_{Pii}\left[P_i^{ij}-P_i^{n+\frac{1}{3}}\right]+[C_{Sii}+F_{Sii}]\left[S_i^{n+\frac{2}{3}}-S_i^n\right]+\sum_{j\neq i}[F_{Pij}\quad F_{Sij}]\begin{bmatrix}P_j^{ij}-P_j^{n+\frac{1}{3}}\\ S_j^{n+\frac{2}{3}}-S_j^n\end{bmatrix}=C_i-C_{Pii}P_i^{n+\frac{1}{3}}-[F_{Pii}\quad C_{Sii}+F_{Sii}]\begin{bmatrix}P_i^{n+\frac{1}{3}}\\ S_i^n\end{bmatrix}-\sum_{j\neq i}[F_{Pii}\quad F_{Sij}]\begin{bmatrix}P_j^{n+\frac{1}{3}}\\ S_j^n\end{bmatrix} \quad (1.2.27)$$

Equation (1.2.26) may be used to eliminate the pressure difference $P_j^{ij}-P_j^{n+1/3}$ from Equation (1.2.27). However, it would be advantageous if Equation (1.2.26) could be used to eliminate the pressure difference $P_i^{ij}-P_i^{n+1/3}$ from Equation (1.2.27) at the same time. The most likely conditions that would permit the elimination of both pressure differences is to have $$F_{Pi}{}^{ij}=-F_{Pj}{}^{ij}, \quad (1.2.28)$$

$$F_{TPi}{}^{ij}=-F_{TPj}{}^{ij}. \quad (1.2.29)$$

These relations are approximately true, and it will be assumed that if the pressure difference $P_j^{ij}-P_j^{n+1/3}$ is eliminated the other pressure difference $P_i^{ij}-P_i^{n+1/3}$ will disappear as well. In effect, when equation (1.2.26) is used to eliminate $F_{Pij}(P_j^{ij}-P_j^{n+1/3})$, it is assumed that this elimination simultaneously eliminates this connection's contribution to the product $F_{Pii}(P_i^{ij}-P_i^{n+1/3})$. The resultant equation is $$\left(C_{Sii}+F_{Sii}-\sum_{j\neq i}\frac{F_{Pij}F_{TSi}^{ij}}{F_{TPj}^{ij}}\right)\left(S_i^{n+\frac{2}{3}}-S_i^n\right)+\sum_{j\neq i}\left(F_{Sij}-\frac{F_{Pij}F_{TSj}^{ij}}{F_{TPj}^{ij}}\right)\left(S_j^{n+\frac{2}{3}}-S_j^n\right)=C_i-C_{Pii}P_i^{n+1}-[F_{Pii}\quad C_{Sii}+F_{Sii}]\begin{bmatrix}P_i^{n+1}\\S_i^n\end{bmatrix}-\sum_{j\neq i}[F_{Pij}\quad F_{Sij}]\begin{bmatrix}P_j^{n+1}\\S_j^n\end{bmatrix} \tag{1.2.30}$$

1.3 Solution of the Implicit Matrix Equation

The equations developed above are used to construct a linear equation solver. It is assumed that a reservoir simulator executing a fully implicit simulation generates an implicit linear equation of the form Ax=b. The reservoir simulator provides the matrix A and vector b as input data to the linear equation solver of the present invention. The linear equation solver returns an estimate for the solution $x=A^{-1}b$ to the reservoir simulator. The linear equation solver employs an iterative method according to the present invention for solving the implicit linear equation. Each iteration operates on a current estimate $x^n$ and generates an updated estimate $x^{n+1}$. The sequence of estimates $x^0, x^1, x^2, \ldots, x^n, \ldots$ generated by the linear equation solver converge to the solution $A^{-1}b$ of the implicit linear equation. Given a current estimate $$x^n=\begin{bmatrix}P^n\\S^n\end{bmatrix},$$

where $p^n$ is a vector of cell pressures (one pressure per cell), and $S^n$ is a vector of saturations (M-1 saturations per cell for reservoir models with M conserved species), a generic iteration of the linear solver method includes the following steps.

1. Construct the IMPES pressure equation (1.2.13). This is achieved by performing the column summation indicated by Eq. (1.2.5). In other words, for each diagonal saturation submatrix $A_{Sii}$ of matrix A, the diagonal saturation submatrix $A_{Sii}$ is added to the off-diagonal saturation submatrices $A_{Sji}$ in the same block-column, thereby generating a corresponding saturation capacitance submatrix $C_{Sii}$. The saturation capacitance submatrix $C_{Sii}$ relates to the accumulation of each of the species in cell i. Using the capacitance submatrices, the well-known IMPES reduction is performed. The IMPES reduction results in matrix equation (1.2.13) which involves only the pressure variables.
2. Construct the saturation equation (1.2.30) as described above.
3. If necessary, compute the underlying implicit equation residuals.
4. Based on the current implicit equation residuals, compute the IMPES pressure equation residuals.
5. Solve the IMPES pressure equation (1.2.13) for updated pressures $P_i^{n+1/3}$, and compute a corresponding set of pressure changes $P_i^{n+1/3}=P_i^n$, where $P_i^n$ denotes cell pressures at the beginning of the current iteration.
6. Update the implicit equation residuals for the pressure changes computed in step 5.
7. Solve the saturation equation (1.2.30) for updated saturations $S_i^{n+2/3}$, and compute a corresponding set of saturation changes $S_i^{n+2/3}-S_i^n$.
8. Update the implicit equation residuals for the saturation changes computed in step 7.
9. Combine the pressure and saturation changes of steps 5 and 7 into a composite solution change $$\Delta x_{comp}=\begin{bmatrix}P^{n+1/3}-P^n\\S^{n+2/3}-S^n\end{bmatrix}.$$

10. Feed this solution change $\Delta x_{comp}$ to a solution accelerator such as ORTHOMIN or GMRES to accelerate convergence.
11. Update the implicit equation residuals based on the solution estimate $$x^{n+1}=\begin{bmatrix}P^{n+1}\\S^{n+1}\end{bmatrix}$$

returned by the accelerator.

Steps 4–11 are Repeated Until Convergence is Attained.

Figure 2A:
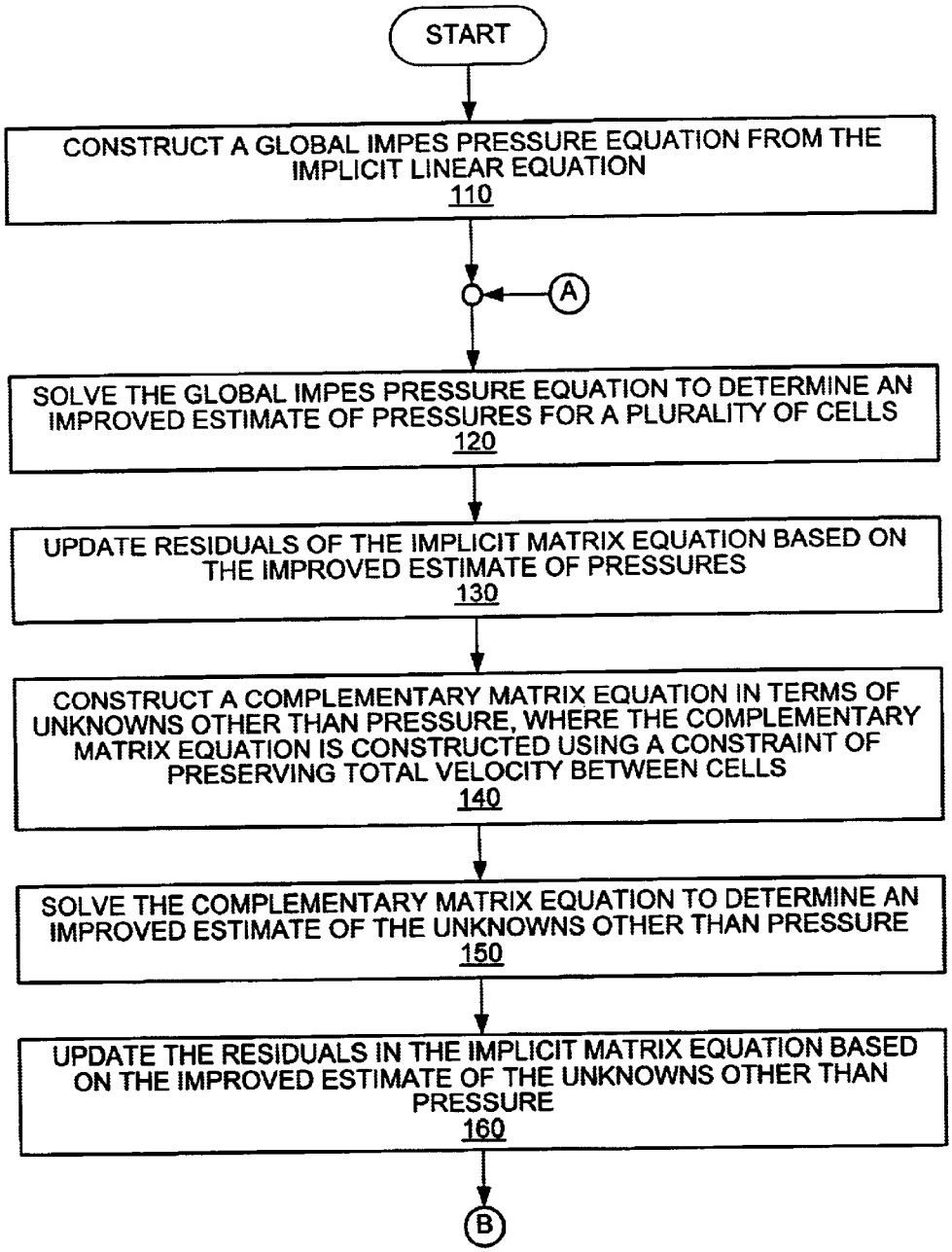
FIGS. 2A & 2B illustrate one embodiment of a linear solver method according to the present invention.
Figure 2B:
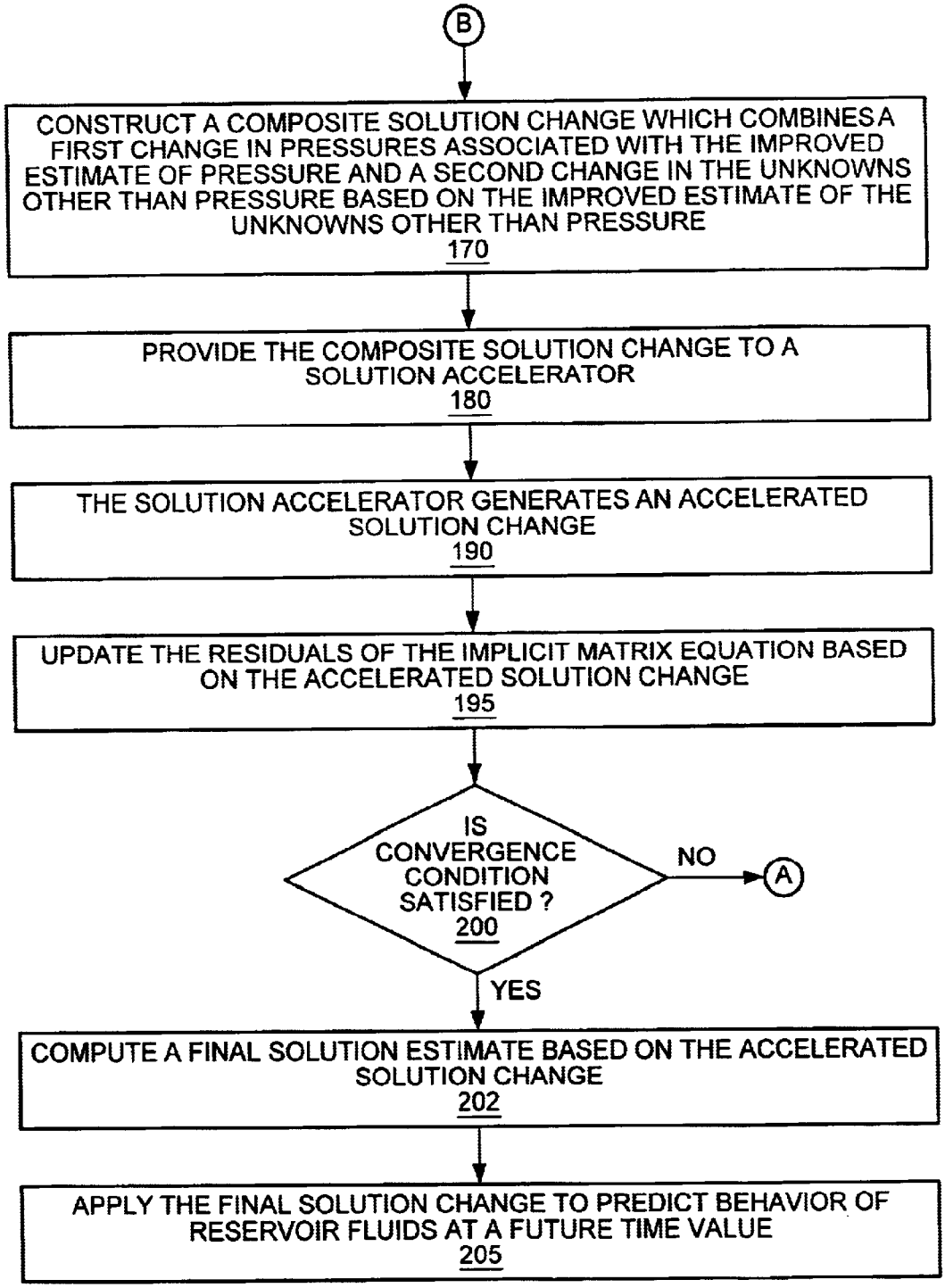

FIGS. 2A & 2B illustrate one embodiment of the linear solver method according to the present invention. The linear solver method shown in FIGS. 2A & 2B may be implemented in software on a computer system. The linear solver method is typically invoked by a reservoir simulator also implemented in software. The reservoir simulator provides the linear solver method with an implicit matrix equation Ax=b which results from a Newton iteration on the fully implicit equations. The linear solver method comprises the following steps.

In step 110, a global IMPES pressure equation is constructed from the implicit matrix equation Ax=b. The global IMPES pressure equation may be constructed as described above in the development of IMPES pressure equation (1.2.13).

In step 120, the global IMPES pressure equation is solved to determine an improved estimate of pressure at a plurality of cells. In the preferred embodiment, the plurality of cells include all the cells of the reservoir. In another embodiment, the plurality of cells may represent a subset of the cells of the reservoir.

In step 130, residuals of the implicit matrix equation are updated based on the improved estimate of pressures.

In step 140, a complementary matrix equation is constructed in terms of unknowns other than pressure. The complementary matrix equation is constructed from the implicit matrix equation based on the constraint of preserving total velocity between cells. For example, the complementary matrix equation may be saturation equation (1.2.30).

In step 150, the complementary matrix equation is solved in order to determine an improved estimate of the unknowns other than pressure at each cell of the reservoir.

In step 160, the residuals of the implicit matrix equation are updated based on the improved estimate of the unknowns other than pressure.

In step 170, a composite solution change which comprises a first change in pressure associated with the improved estimate of pressures determined in step 120 and a second change in the unknowns other than pressure associated with the improved estimate of the unknowns other than pressure.

The composite solution change is treated as the output of a preconditioner. In step 180, the composite solution change is provided to an accelerator such as, e.g., GMRES or ORTHOMIN, in order to accelerate convergence of the solution.

In step 190, the solution accelerator generates an accelerated solution change.

In step 195, the residuals of the implicit matrix equation are updated based on the accelerated solution change.

In step 200, a test is performed to determine if a convergence criteria has been satisfied. If the convergence criteria is not satisfied, another iteration of steps 120 through 195 is performed. If the convergence criteria is satisfied, a final solution estimate is computed based on the accelerated solution change and a previous solution estimate as indicated by step 202.

In step 205, the final solution estimate is applied to predict the behavior of reservoir fluids at a future time value.

In one embodiment of the linear solver method, the complementary matrix equation is a saturation matrix equation such as equation (1.2.30), and the unknowns other than pressure are saturations.

In another embodiment, the unknowns other than pressure comprise one or more variables such as, e.g., saturation, mole fraction, mass, energy, etc.

Figure 3:
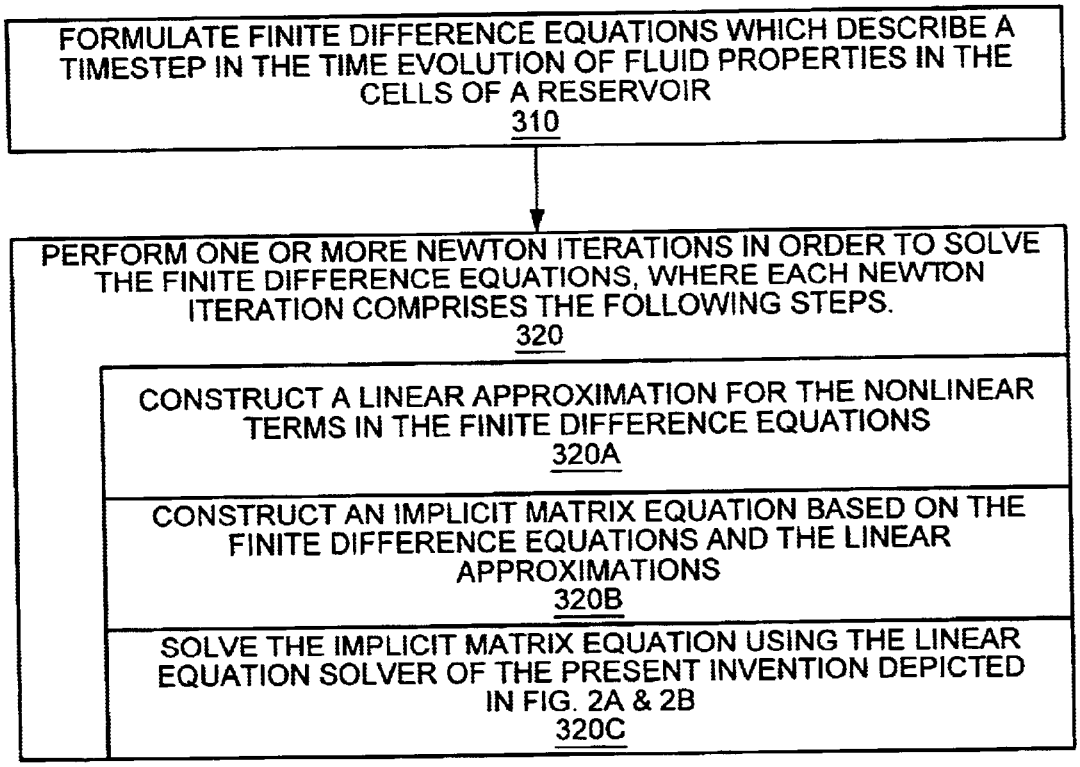
FIG. 3 illustrates a reservoir simulation method which invokes a linear solver according to the present invention.

FIG. 3 illustrates the structure of a reservoir simulator method which invokes the linear solver method as described above. In step 310, the reservoir simulator formulates a set of finite difference equations which describe a generalized timestep in the time evolution of fluid properties in the cells of a reservoir. In step 320, the reservoir simulator performs one or more Newton iterations in order to solve the finite difference equations for a single timestep. The solution of the finite difference equations defines a pressure and one or more complementary unknowns for each cell in the reservoir at the next discrete time level.

Each Newton iteration comprises the following steps. In step 320A, a linear approximation is constructed for each of the non-linear terms in the finite difference equations. In step 320B, an implicit matrix equation is constructed based on the finite difference equations and the linear approximations. In step 320C, the implicit matrix equation is solved using the linear equation solver method discussed above in connection with FIGS. 2A & 2B.

By performing a series of timesteps as described above, the reservoir simulator may predict the behavior of the reservoir fluids.

1.4 A Preconditioner for Solving the Implicit Matrix Equation

The present invention also comprises a preconditioning method for solving the implicit matrix equation Ax=b. The preconditioning method has performed effectively in a variety of problems.

Given a current estimate $$x^n = \begin{bmatrix} P^n \\ S^n \end{bmatrix}$$

for the solution to the implicit matrix equation, where $P^n$ is a vector of cell pressures and $S^n$ is a vector of cell saturations, the preconditioning method of the present invention comprises the following steps:

(1) Solve the IMPES pressure equation for an updated pressure vector $P^{n+1/3}$, and compute pressure change vector $p^{n+1/3}-P^n$;

(2) Update the implicit equation residuals for the pressure change $p^{n+1/3}-P^n$;

(3) Solve saturation equations (1.2.33) for updated saturation vector $S^{n+2/3}$, and compute saturation change vector $S^{n+2/3}-S^n$; and (4) Update the implicit equation residuals for the saturation change $S^{n+2/3}-S^n$.

The composite solution change $$\Delta x_{comp} = \begin{bmatrix} P^{n+\frac{1}{3}} - P^n \\ S^{n+\frac{2}{3}} - S^n \end{bmatrix}$$

is supplied to a solution accelerator such as Orthomin or GMRES.

Any suitable method can be used to solve the IMPES pressure equation. The saturation equations tend to be easy to solve, in the sense that an iterative solution of saturation equations converges rapidly. This suggests use of a simple preconditioner such as diagonal scaling or ILU(0). ILU(0) was used in the tests described below.

The preconditioning method of the present invention differs from the Constrained Pressure Residual Method (Wallis, J. R., Kendall, R. P., and Little, T. E.: "Constrained Residual Acceleration of Conjugate Residual Methods," SPE 13536 presented at the SPE 1985 Reservoir Simulation Symposium, Dallas, Tex., Feb. 10–13, 1985) in at least two ways. First, the preconditioning method of the present invention obtains the pressure equation using the true IMPES reduction. Wallis et al. perform a reduction directly on the implicit equations. Second, the preconditioner method of the present invention solves the total-velocity saturation equations. Wallis et al. perform a single iteration on the implicit equations using a preconditioner, typically reduced system ILU(0).

Test Results and Discussion

The preconditioner method has been tested on a handful of matrix equations. Table 1 below summarizes the results. The convergence criterion used was a 0.005 reduction in the residual $L^2$ norm. Case 1 was a variant of the first SPE comparison problem (Odeh, A. S.: "Comparisons of Solutions to a Three-Dimensional Black-Oil Reservoir Simulation Problem," JPT 33, Jan. 13–25, 1981), with the wells being treated as flowing against constant pressure. Case 2 was the first Newton iteration of the first timestep of the ninth SPE comparison problem (Killough, J. E.: "Ninth SPE Comparative Solution Project: A Reexamination of Black-Oil Simulation," SPE 29110 presented at the 13$^{th}$ SPE Symposium on Reservoir Simulation, San Antonio, Tex., Feb. 12–16, 1995), with a one day timestep. Case 3 was the same as case 2, with the timestep size increased to 50 days to make the problem more difficult. Case 4 was the same as case 3, but for the second Newton iteration. Case 5 was from a 2400-cell, two-hydrocarbon component, steam injection model. Case 6 was from a 5046-cell, seven-hydrocarbon component plus water compositional model.

The logical comparison to make is to the Constrained Pressure Residual (CPR) Method. In these problems, the new method took either the same number as or somewhat fewer outer iterations than CPR. It required on average a little less than two saturation iterations per outer iteration. The resulting computational work required was probably somewhat less than that required by CPR's single reduced-system ILU(0) iteration.

TABLE 1

Performance of Two-Stage Preconditioner

| Case | Outer Iterations | Saturation Iterations |
|---|---|---|
| 1 | 2 | 2 |
| 2 | 1 | 1 |
| 3 | 1 | 2 |
| 4 | 3 | 8 |
| 5 | 3 | 6 |
| 6 | 5 | 5 |

Total Velocity Preconditioning in a Reservoir Simulator

Figure 4:
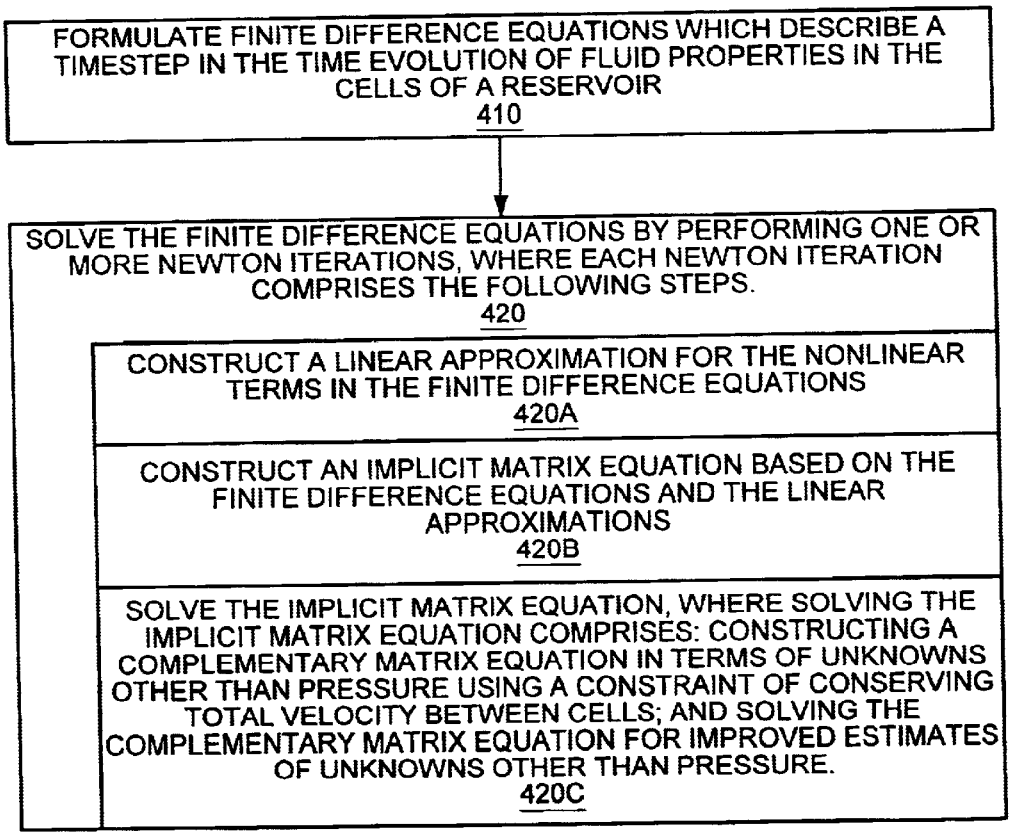
FIG. 4 illustrates a reservoir simulation method which uses total velocity sequential preconditioning according to the present invention.

FIG. 4 illustrates a reservoir simulation method which uses total velocity sequential preconditioning according to the present invention. The reservoir simulation method comprises the following steps. In step 410, the reservoir simulator formulates a set of finite difference equations which describe a generalized timestep in the time evolution of fluid properties such as pressure, saturation, etc. for each cell in the reservoir.

In step 420, the reservoir simulator solves the finite difference equations by performing one or more Newton iterations. The solution of the finite difference equations specify the value of pressure and complementary unknowns (i.e. unknowns other than pressure) for each cell at the next time level. For each Newton iteration, the reservoir simulator:

(a) Constructs a linear approximation for each of the non-linear terms in the finite difference equations as indicated by step 420A;

(b) Constructs an implicit matrix equation based on the finite difference equations and the linear approximations as indicated by step 420B; and (c) Solves the implicit matrix equation by (c1) constructing a complementary matrix equation in terms of unknowns other than pressure, and (c2) solving the complementary matrix equation for the unknowns other than pressure as indicated by step 420C. The complementary matrix equation is constructed using a constraint of conserving total velocity between cells.

By performing a succession of timesteps, i.e. by repeatedly solving the finite difference equations, the time evolution of pressure and the complementary unknowns may be predicted. This information may be used, e.g., to guide the development and management of a physical reservoir such as an oil field.

1.5 Linear Solvers for Variable Implicit and Adaptive Implicit Simulations

The present invention comprises a method for solving the matrix equations which arise in variable implicit and adaptive implicit reservoir simulations. As discussed above, the fully implicit formulation requires significantly more computational effort per timestep than the IMPES formulation. However, the larger timesteps that may be used with the fully implicit formulation often more than offsets the additional computational effort.

The nonlinearity of the fully implicit formulation requires an iterative solution using Newton's method. Each Newton iteration generates a matrix equation referred to herein as the implicit matrix equation. Thus, one timestep of the fully implicit formulation requires the solution of a series of implicit matrix equations. This explains the large computational effort of the fully implicit formulation.

One prior-art method used to lower the cost of reservoir simulations is the so called adaptive implicit method (AIM). The adaptive implicit method is based on the recognition that the implicit formulation is required at only a fraction of the cells in the reservoir model. If the implicit formulation can be applied only where it is needed, with the IMPES formulation being used at the remaining cells, significant reductions in computational effort may be obtained. The adaptive implicit method determines dynamically which cells require implicit formulation. As the simulation progresses in time, a particular cell may switch back and forth between IMPES formulation and implicit formulation.

In a related prior-art method, referred to as static variable implicitness, the assignment of IMPES or implicit formulation to each cell in the reservoir remains fixed through the simulation.

In variable implicit and adaptive implicit reservoir simulations, the nonlinear implicit equations which describe the implicit cells and the linear IMPES equations which describe the IMPES cells are coupled. Thus, the composite system of equations from all the cells is nonlinear and requires a Newton's method solution. The composite system is solved in a series of Newton iterations. Each Newton iteration results in a mixed implicit-IMPES matrix equation.

Solution of the mixed implicit-IMPES matrix equation poses a challenge to a linear equation solver. This section describes two related methods according to the present invention that may increase the efficiency of solving the mixed implicit-IMPES matrix equation.

Figure 5:
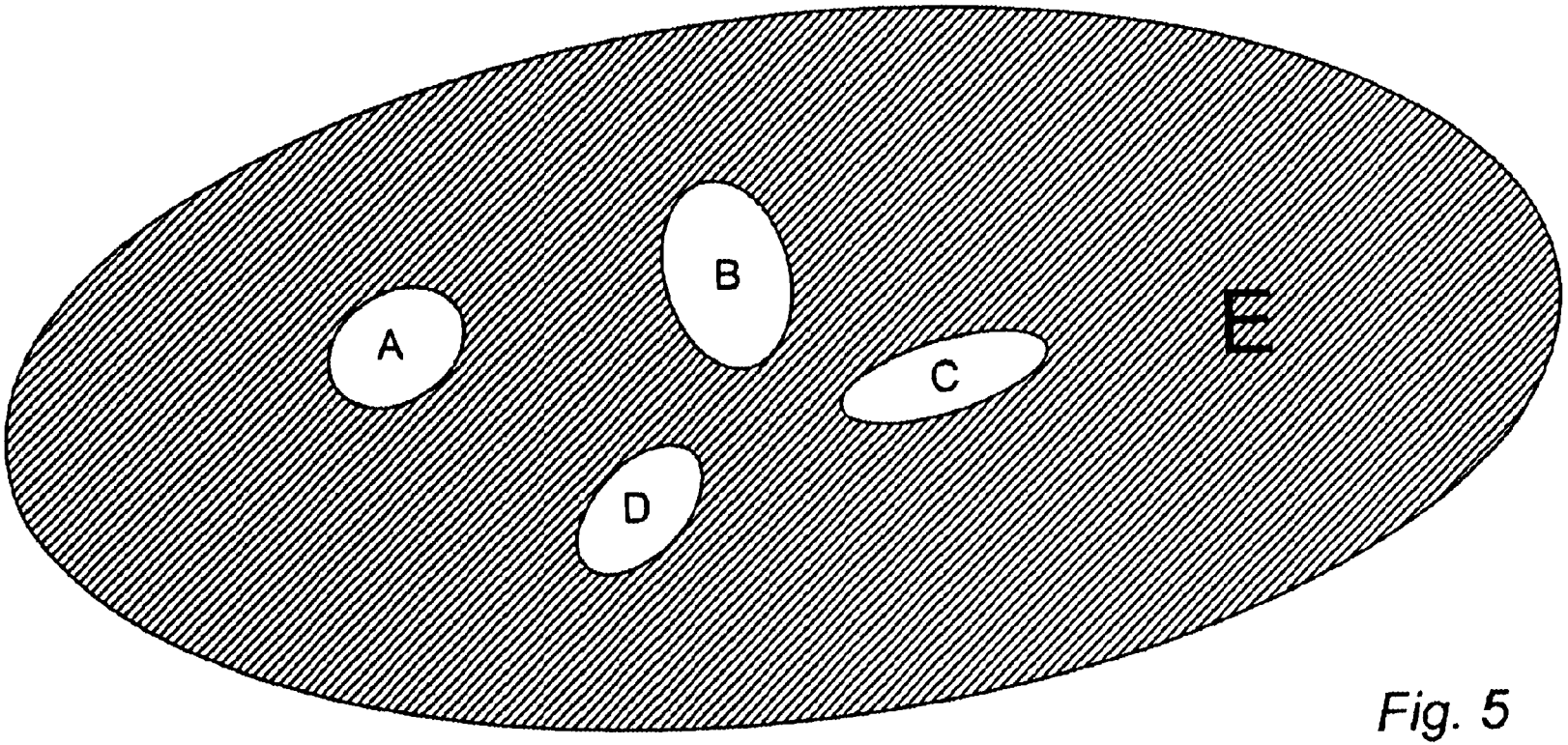
FIG. 5 illustrates a partitioning of cells in a variable implicit reservoir simulation.

When variable implicitness is used in a reservoir simulation, only a small minority, typically one to ten percent, of the cells are treated implicitly. As shown in FIG. 5, the implicit cells tend to appear as small islands (e.g. islands A, B, C and D) in a much larger IMPES ocean E. At the IMPES cells, there is a single unknown to be solved for, and correspondingly there is a single equation to be solved. At the implicit cells, the number of unknowns is equal to the number of components (such as, e.g., oil, water and gas) being used in the model.

Solving the Mixed Implicit-IMPES Matrix Equation: Method 1

This section presents a first linear solver method according to the present invention for solving the mixed implicit-IMPES matrix equation Ax=C. The vector unknown x comprises a set of cell pressures $P_i$ (one pressure per cell) and a set of saturations $S_i$ (M−1 saturations per cell for simulations with M conserved species). The matrix A and the vector C are supplied to the linear solver method as inputs by a reservoir simulator. The linear solver method generates an estimate for the solution $A^{-1}C$ to the mixed implicit-IMPES equation. The linear solver method comprises an iterative procedure. Each iteration of the linear solver method operates on a current solution estimate $x^n$ and generates an updated solution estimate $x^{n+1}$. The sequence of solution estimates $x^0, x^1, x^2, \ldots, x^n, \ldots$ converges to the solution $A^{-1}C$ of the mixed implicit-IMPES equation. The linear solver method employs a convergence criteria to determine when iterations should terminate. Each iteration of the linear solver method comprises the following steps.

1. Construct a global IMPES pressure matrix equation from the mixed implicit-IMPES matrix equation. The global IMPES pressure matrix equation comprises one scalar IMPES equation per cell of the reservoir. The mixed implicit-IMPES equation already specifies the scalar IMPES pressure equation for each of the IMPES cells. At each of the implicit cells, a scalar IMPES pressure equation may be generated by combining the implicit equations according to the procedure described above in the sections entitled "Generating Total Velocity Sequential Equations" and "The Volume Balance Equation".

2. Compute the coefficients for the saturation equations (1.2.30) at the implicit cells.
3. Solve the global IMPES pressure matrix equation for intermediate pressures $P_i^{n+1/3}$, i.e. a single intermediate pressure at each cell in the reservoir, and compute pressure changes $P_i^{n+1/3}-P_i^n$ based on the intermediate pressures $P_i^{n+1/3}$ and pressures $P_i^n$ prevailing at the beginning of the iteration.
4. Update implicit equation residuals at the implicit cells based on the pressures changes $P_i^{n+1/3}-P_i^n$ computed in step 3.
5. At the implicit cells, solve for improved saturations $S_i^{n+2/3}$ in saturation equations (1.2.30) which are derived using a constraint of total velocity conservation between cells.
6. Update implicit equation residuals at the implicit cells and at the fringe of IMPES cells that are in flow communication with the implicit cells based on the saturation solutions obtained in step 5.
7. Determine if a convergence condition is satisfied.

Steps 2–6 are repeated until the convergence condition is satisfied. Note that at the end of step 6, the only cells where the residuals fail to meet the convergence criteria are the implicit cells and the fringe of IMPES cells in flow communication with any implicit cell. The residuals at the IMPES cells outside the fringe still are at the values they had following the IMPES solution. This means that ORTHOMIN or GMRES computations need be applied only at these cells, i.e. at the implicit cells and fringe IMPES cells.

Figure 6A:
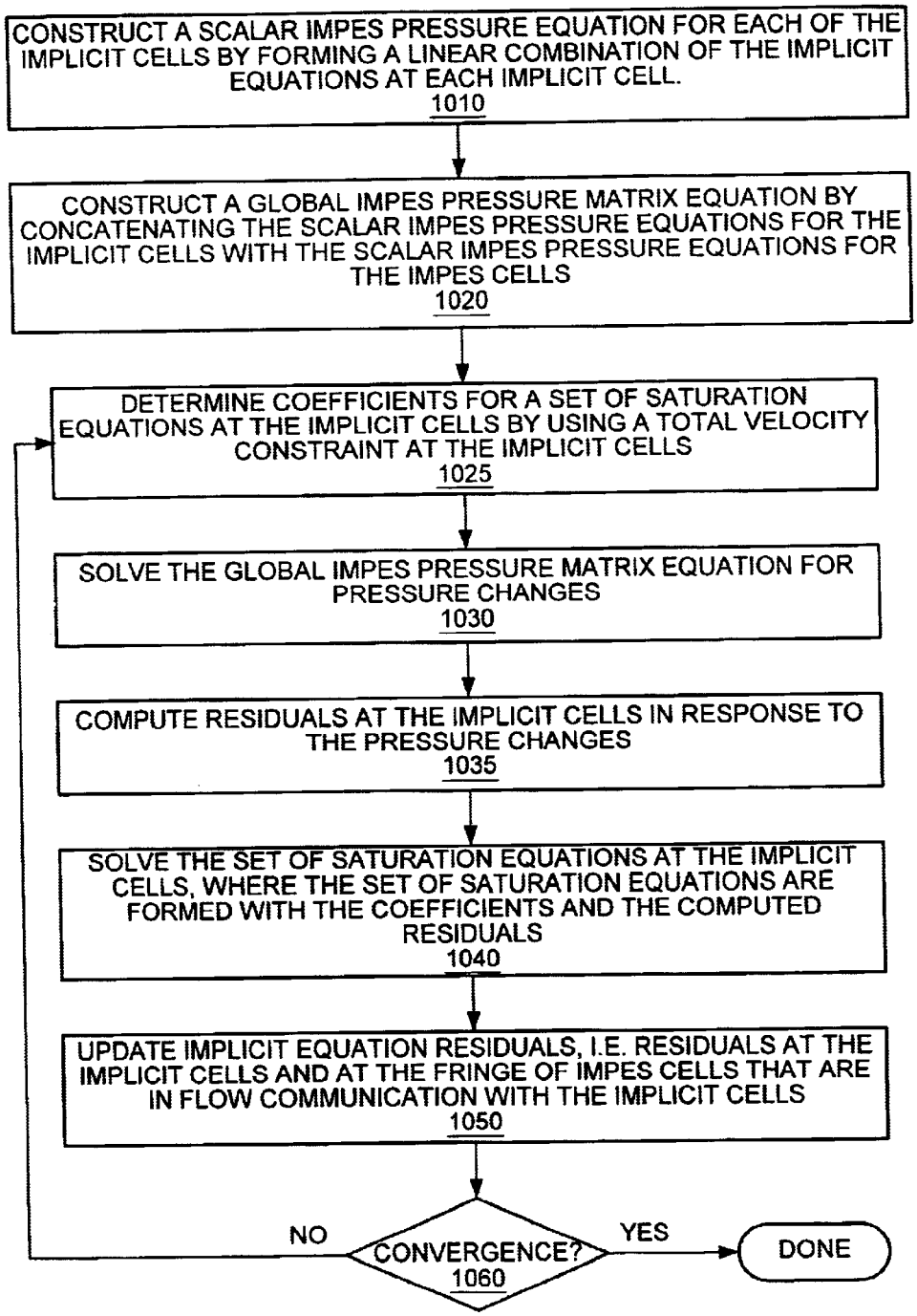
FIG. 6A illustrates a first iterative method for solving a mixed implicit-IMPES matrix equation according to the present invention.

FIG. 6A illustrates the first method for solving the mixed implicit-IMPES matrix equation according to the present invention. The mixed implicit-IMPES matrix equation specifies a set of implicit equations for each implicit cell and a single scalar IMPES pressure equation for each IMPES cell.

In step 1010, a scalar IMPES pressure equation is constructed for each of the implicit cells. The scalar IMPES pressure equation for an implicit cell is generated by forming a linear combination of the implicit equations which correspond to the implicit cell.

In step 1020, a global IMPES pressure matrix equation is constructed by concatenating the scalar IMPES pressure equations for the implicit cells with the scalar IMPES pressure equations for the IMPES cells. The scalar IMPES pressure equations for the IMPES cells are provided by the mixed implicit-IMPES matrix equation.

In step 1025, coefficients for a set of saturation equations are determined at the implicit cells by using a total velocity constraint at the implicit cells.

In step 1030, the global IMPES pressure matrix equation is solved for pressure changes. In step 1035, the residuals at the implicit cells are computed in response to the pressure changes determined in step 1030.

In step 1040, the set of saturation equations are solved at the implicit cells. The set of saturation equations are formed using the coefficients (determined in step 1025) and the residual computed in step 1035.

In step 1050, implicit equation residuals (i.e. residuals at the implicit cells and at the fringe of IMPES cells that are in flow communication with the implicit cells) are updated in response to the saturation changes.

In step 1060, a convergence condition is tested based on the updated residuals. If the convergence condition is not satisfied, processing continues with another iteration of step 1025. If the convergence condition is satisfied, the method terminates and the final solution estimate is provided to the calling routine which is generally a reservoir simulator. When the convergence condition is satisfied, it is assumed that the solution to the mixed implicit-IMPES equations has been determined with acceptable accuracy. The final solution estimate comprises a set of converged saturations and pressures which are used by the reservoir simulator in modeling characteristics of the reservoir.

Solving the Mixed Implicit-IMPES Matrix Equation: Method 2

This section presents a second linear solver method according to the present invention for solving the mixed implicit-IMPES matrix equation Ax=C. Each iteration of the second linear solver method comprises the following steps.

1. Construct a global IMPES pressure matrix equation from the mixed implicit-IMPES matrix equation. The global IMPES pressure matrix equation comprises one scalar IMPES equation per cell of the reservoir. The mixed implicit-IMPES equation already specifies the scalar IMPES pressure equation for each of the IMPES cells. At each of the implicit cells, a scalar IMPES pressure equation may be generated by combining the implicit equations according to the procedure described above in the sections entitled "Generating Total Velocity Sequential Equations" and "The Volume Balance Equation".
2. Solve the global IMPES pressure matrix equation for intermediate pressures $P_i^{n+1/3}$, i.e. a single intermediate pressure at each cell in the reservoir, and compute pressure changes $P_i^{n+1/3}-P_i^n$ based on the intermediate pressures $P_i^{n+1/3}$ and pressures $P_i^n$ prevailing at the beginning of the iteration.
3. Compute implicit equation residuals at the implicit cells based on the pressures changes $P_i^{n+1/3}-P_i^n$ computed in step 2.
4. At the implicit cells, solve for improved saturations $S_i^{n+2/3}$ and second intermediate pressures $P_i^{n+2/3}$ by performing one or more iterations with a selected preconditioner such as, e.g., ILU(0).
5. Update implicit equation residuals at the implicit cells and at the fringe of IMPES cells that are in flow communication with the implicit cells based on the improved saturations and second intermediate pressures obtained in step 4.
6. Determine if a convergence condition is satisfied.

Steps 2–6 are repeated until the convergence condition is satisfied. Note that at the end of step 5, the only cells where the residuals fail to meet the convergence criteria are the implicit cells and the fringe of IMPES cells in flow communication with any implicit cell. The residuals at the IMPES cells outside the fringe still are at the values they had following the IMPES solution. This means that ORTHOMIN or GMRES computations need be applied only at these cells, i.e. at the implicit cells and fringe IMPES cells.

Figure 6B:
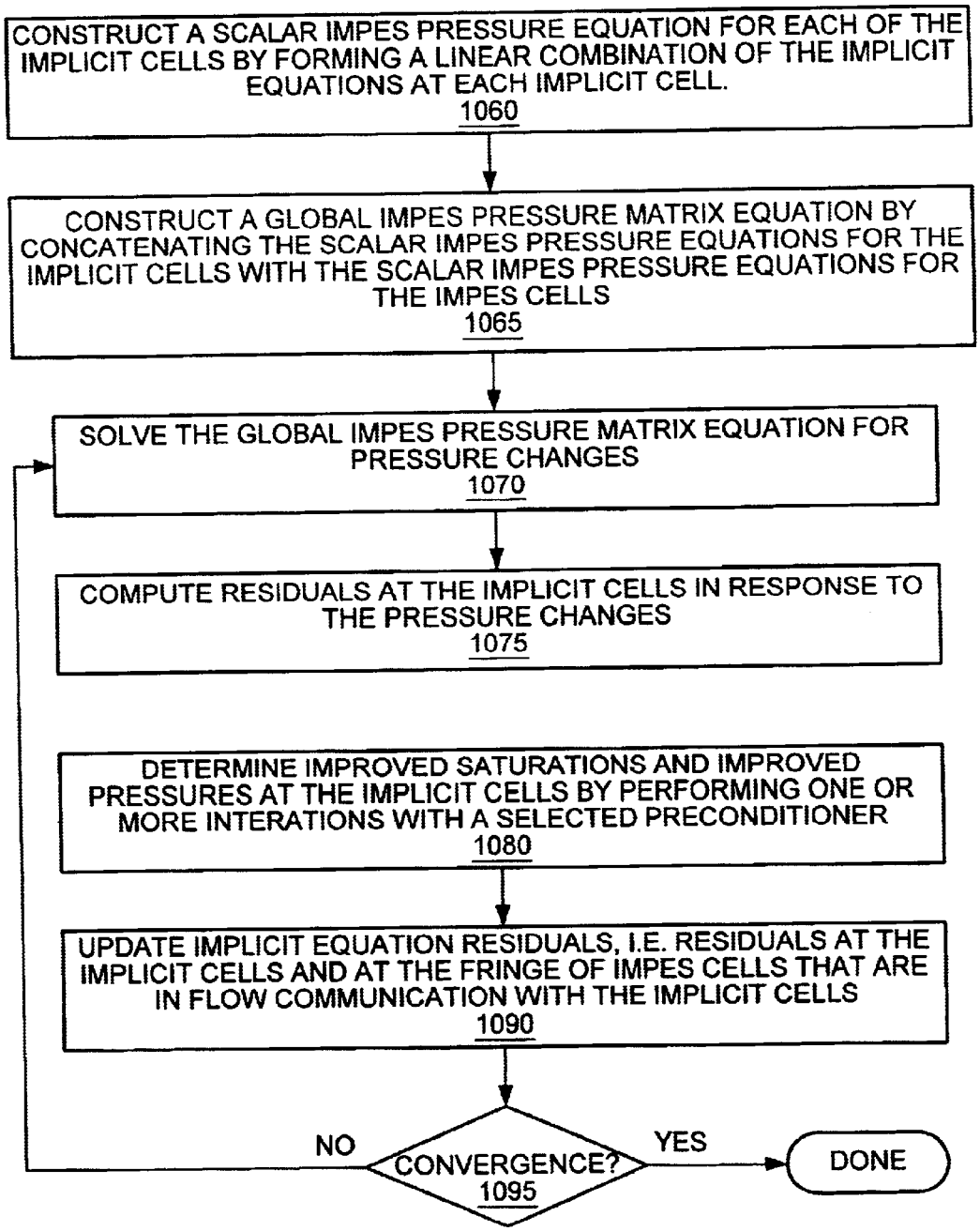
FIG. 6B illustrates a second iterative method for solving a mixed implicit-IMPES matrix equation according to the present invention.

FIG. 6B illustrates the second method for solving the mixed implicit-IMPES matrix equation according to the present invention. The mixed implicit-IMPES matrix equation specifies a set of implicit equations for each implicit cell and a single scalar IMPES pressure equation for each IMPES cell.

In step 1060, a scalar IMPES pressure equation is constructed for each of the implicit cells. The scalar IMPES pressure equation for an implicit cell is generated by forming a linear combination of the implicit equations which correspond to the implicit cell.

In step 1065, a global IMPES pressure matrix equation is constructed by concatenating the scalar IMPES pressure equations for the implicit cells with the scalar IMPES pressure equations for the IMPES cells. The scalar IMPES pressure equations for the IMPES cells are provided by the mixed implicit-IMPES matrix equation.

In step 1070, the global IMPES pressure matrix equation is solved for pressure changes. In step 1075, the residuals at the implicit cells are computed in response to the pressure changes determined in step 1070.

In step 1080, improved saturations and improved pressures at the implicit cells may be determined by performing one or more iterations with a selected preconditioner such as ILU(0).

In step 1090, implicit equation residuals (i.e. residuals at the implicit cells and at the fringe of IMPES cells that are in flow communication with the implicit cells) are updated in response to the improved saturations and improved pressures.

In step 1095, a convergence condition is tested based on the updated residuals. If the convergence condition is not satisfied, processing continues with another iteration of step 1070. If the convergence condition is satisfied, the method terminates and the final solution estimate is provided to the calling routine which is generally a reservoir simulator. When the convergence condition is satisfied, it is assumed that the solution to the mixed implicit-IMPES equations has been determined with acceptable accuracy. The final solution estimate comprises a set of converged saturations and pressures which are used by the reservoir simulator in modeling characteristics of the reservoir.

Solving the Mixed Implicit-IMPES Matrix Equation: Method 3

In this subsection, a third method according to the present invention for solving the mixed implicit-IMPES matrix equation is presented. The structure of this third method may be the same as that of the second method described above except in steps 4 and 5. In this third method, steps 4 and 5 may be replaced by steps $4^{II}$ and $5^{II}$ respectively.

$4^{II}$. Solve for saturations $S_j^{n+2/3}$ and pressures $P_j^{n+2/3}$ at the implicit cells while holding fixed the pressures in the surrounding fringe (of IMPES cells) to the values $P_i^{n+1/3}$ determined during the IMPES pressure solution. Any method can be used to generate the solutions for saturations $S_j^{n+2/3}$ and pressures $P_j^{n+2/3}$, but it must be able to deal with the unstructured form of the implicit cell equations.

$5^{II}$. Update residuals in the fringe of IMPES cells. Since the implicit equations have been solved, their residuals will satisfy the convergence criteria.

After step $5^{II}$, only the fringe cells will have residuals that fail to meet the convergence criteria. Again, ORTHOMIN or GMRES only need be applied to these cells.

Figure 7:
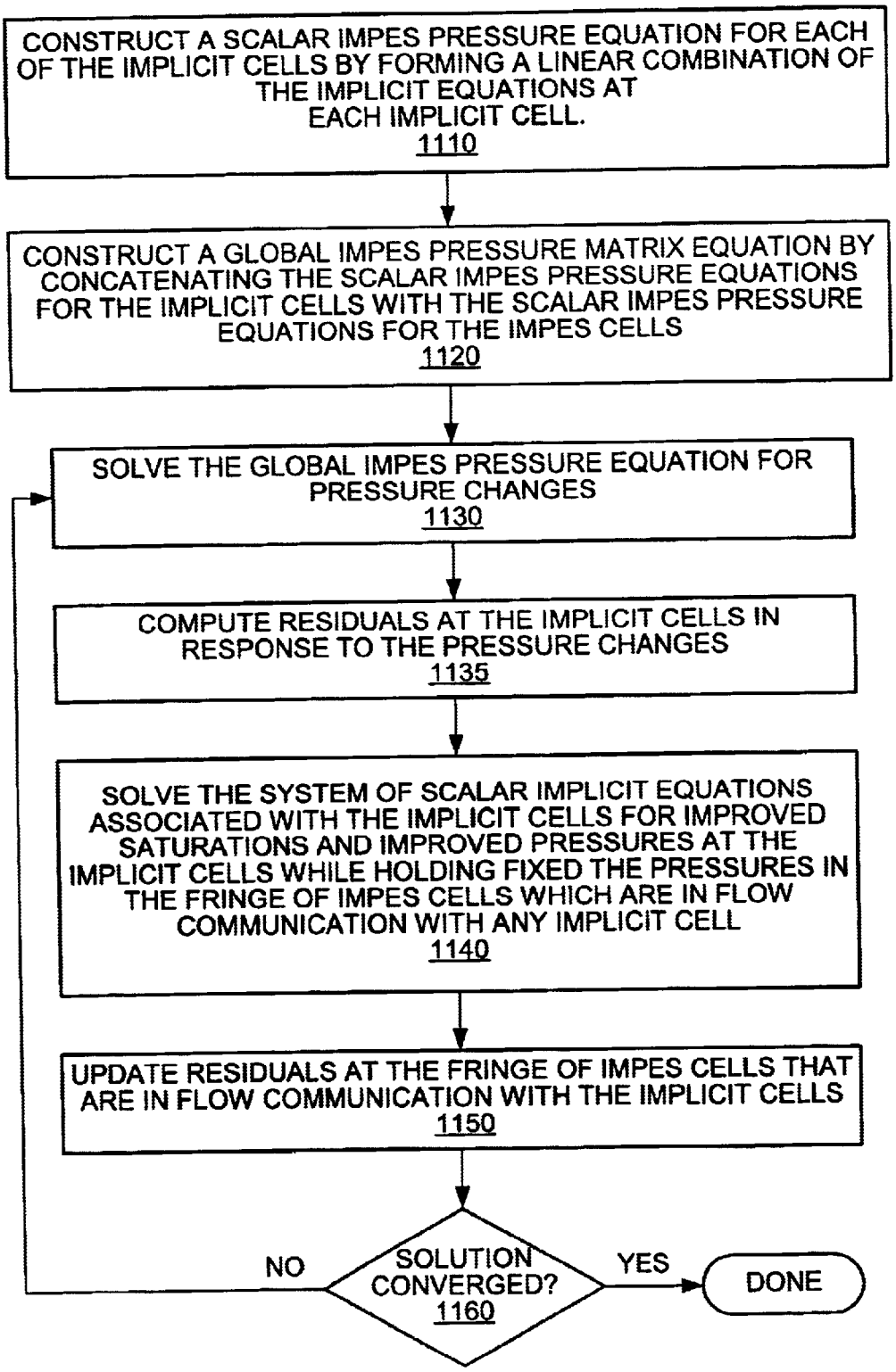
FIG. 7 illustrates a third iterative method for solving a mixed implicit-IMPES matrix equation according to the present invention.

FIG. 7 illustrates one embodiment of the third method for solving the mixed implicit-IMPES matrix equation according to the present invention. The mixed implicit-IMPES matrix equation specifies a set of implicit equations for each implicit cell and a single scalar IMPES pressure equation for each IMPES cell. The embodiment of FIG. 7 comprises the following steps.

In step 1110, a scalar IMPES pressure equation is constructed for each of the implicit cells. The scalar IMPES pressure equation for an implicit cell is constructed by forming a linear combination of the implicit equations which correspond to the implicit cell.

In step 1120, a global IMPES pressure matrix equation is constructed by concatenating (a) the scalar IMPES pressure equations for the implicit cells and (b) the scalar IMPES pressure equations for the IMPES cells. The scalar IMPES pressure equations for the IMPES cells are provided directly by the mixed implicit-IMPES matrix equation.

In step 1130, the global IMPES pressure equation is solved for pressure changes.

In step 1135, the residuals at the implicit cells are computed in response to the pressure changes determined in step 1130.

In step 1140, improved saturations and improved pressures at the implicit cells are determined by solving the system of implicit equations associated with the implicit cells while holding fixed the pressures in the fringe of IMPES cells which are in flow communication with any implicit cell.

In step 1150, the residuals in the fringe of IMPES cells (which are in flow communication with any implicit cell) are updated.

In step 1160, a convergence condition is tested based on the updated residuals. If the convergence condition is not satisfied, the method continues with a next iteration of step 1130. If the convergence condition is satisfied, iteration terminates and the final solution estimate is returned to the calling routine (e.g. a reservoir simulator). The converged saturations and pressures making up the final solution estimate are used by the reservoir simulator in modeling characteristics of the reservoir.

Observations

Methods 1 and 2 are less expensive than Method 3 per outer iteration. In "easy" problems, only one iteration may be needed, so Methods 1 and 2 would be preferred. In "hard" problems, Method 3 requires fewer outer iterations. As the problem becomes harder, Method 3 becomes preferred. Method 3 effectively requires an unstructured implicit equation solver. If such a solver is not available, Methods 1 and 2 are much easier to implement.

What is claimed is:

1. A method for performing reservoir simulation by solving a mixed implicit-IMPES matrix (MIIM) equation, wherein the MIIM equation arises from a Newton iteration of a variable implicit reservoir model, wherein the variable implicit reservoir model comprises a plurality of cells including implicit cells and IMPES cells, wherein the MIIM equation includes a first scalar IMPES pressure equation for each of the IMPES cells and a first set of implicit equations for each of the implicit cells, the method comprising:

a) constructing a global IMPES pressure matrix equation from the MIIM equation, wherein said constructing the global IMPES pressure matrix equation comprises:

constructing a second IMPES pressure equation for each of the implicit cells from the first set of implicit equations corresponding to the implicit cell; and concatenating the first scalar IMPES pressure equations for the IMPES cells and the second IMPES pressure equations for the implicit cells;

b) determining coefficients for a second set of saturation equations at the implicit cells by using a total velocity constraint at the implicit cells;

c) solving the global IMPES pressure matrix equation for pressure changes;

d) computing first residuals at the implicit cells in response to the pressure changes;

e) solving the second set of saturation equations for saturation changes at the implicit cells, wherein the second set of saturation equations are formed with the coefficients and the first residuals at the implicit cells;

f) computing second residuals at the implicit cells and at a subset of the IMPES cells that are in flow communication with any of the implicit cells in response to the saturation changes;

g) determining if a convergence condition based on the second residuals is satisfied;

h) repeating b) through g) until the convergence condition is satisfied;

i) computing a final solution estimate for the MIIM equation from the pressures changes and the saturation changes after the convergence condition is satisfied;

j) applying the final solution estimate to determine behavior of the reservoir model at a future discrete time value.

2. A method for performing reservoir simulation by solving a mixed implicit-IMPES matrix (MIIM) equation, wherein the MIIM equation arises from a Newton iteration of a variable implicit reservoir model, wherein the variable implicit reservoir model comprises a plurality of cells including implicit cells and IMPES cells, wherein the MIIM equation includes a first scalar IMPES equation for each of the IMPES cells and a set of implicit equations for each of the implicit cells, the method comprising:

a) constructing a global IMPES pressure equation from the MIIM equation, wherein said constructing the global IMPES pressure equation comprises:

constructing a second scalar IMPES pressure equation for each of the implicit cells from the set of implicit equations corresponding to the implicit cell; and concatenating the first scalar IMPES pressure equation for each of the IMPES cells and the second scalar IMPES pressure equation for each of the implicit cells;

b) solving the global IMPES pressure equation for pressure changes;

c) computing first residuals at the implicit cells in response to the pressure changes;

d) determining improved saturations and improved pressures by performing one or more iterations with a selected preconditioner at the implicit cells;

e) computing second residuals at the implicit cells and at a subset of the IMES cells that are in flow communication with any of the implicit cells in response to the improved saturations and improved pressures;

f) determining if a convergence condition based on the second residuals is satisfied;

g) repeating b) through f) until the convergence condition is satisfied;

h) computing a final solution estimate for the MIIM equation from the pressure changes, improved saturations and improved pressures after the convergence condition is satisfied;

i) applying the final solution estimate to determine behavior of the reservoir model at a future discrete time value.

3. A method for performing reservoir simulation by solving a mixed implicit-IMPES matrix (MIIM) equation, wherein the MIIM equation arises from a Newton iteration of a variable implicit reservoir model, wherein the variable implicit reservoir model comprises a plurality of cells including implicit cells and IMPES cells, wherein the MIIM equation includes a first scalar IMPES equation for each of the IMPES cells and a set of implicit equations for each of the implicit cells, the method comprising:

a) constructing a global IMPES pressure equation from the MIIM equation, wherein said constructing the global IMPES pressure equation comprises:

constructing a second scalar IMPES pressure equation for each of the implicit cells from the set of implicit equations corresponding to the implicit cell; and concatenating the first scalar IMPES pressure equation for each of the IMPES cells and the second scalar IMPES pressure equation for each of the implicit cells;

b) solving the global IMPES pressure equation for first pressures;

c) computing improved saturations at the implicit cells;

d) determining if a convergence condition is satisfied;

e) repeatedly performing b) through d) until the convergence condition is satisfied;

f) computing a final solution estimate for the MIIM equation using the improved saturations and first pressures after the convergence condition is satisfied;

i) applying the final solution estimate to determine behavior of the reservoir model at a future discrete time value.

4. A method for performing reservoir simulation by solving an implicit linear equation arising in a Newton iteration of an implicit reservoir model, wherein the reservoir model comprises a plurality of cells, the method comprising:

a) constructing a global IMPES pressure equation from the implicit linear equation, wherein the global IMPES pressure equation comprises one scalar IMPES pressure equation for each of the plurality of cells;

b) solving the global IMPES pressure equation to determine first pressure values, wherein one of the first pressure values is associated with each of the plurality of cells;

c) constructing a complementary matrix equation in terms of unknowns other than pressure, wherein the complementary matrix equation is constructed using a constraint of conserving total velocity between cells;

d) solving the complementary matrix equation to determine improved estimates of the unknowns other than pressure at each of the plurality of cells;

e) constructing a composite solution change which combines a first solution change associated with the first pressure values and a second solution change associated with the improved estimates of unknowns other than pressure;

f) providing the composite solution change to a solution accelerator;

g) the solution accelerator generating an accelerated solution change;

h) determining if a convergence condition is satisfied;

i) repeating (b) through (h) until the convergence condition is satisfied;

j) computing a final solution estimate based on the accelerated solution change after the convergence condition is satisfied;

k) applying the final solution estimate to predict properties of reservoir fluids at a future time value.

5. The method of claim 4, wherein the solution accelerator is GMRES.

6. The method of claim 4, wherein the solution accelerator is ORTHOMIN.

7. The method of claim 4, wherein said constructing a complementary matrix equation in terms of unknown other than pressure comprises constructing a saturation matrix equation, wherein the unknowns other than pressure are saturations.

8. The method of claim 4, wherein said unknowns other than pressure comprise one or more saturations, mole fractions, energies, masses, or volumes.

9. The method of claim 4, further comprising computing first residuals of the implicit matrix equation based on the first pressure values, wherein the first residuals are used to construct the complementary matrix equation.

10. The method of claim 9, further comprising computing second residuals of the implicit matrix equation based on the improved estimates of the unknowns other than pressure, wherein the first residuals and second residuals are provided to the solution accelerator as input data.

11. The method of claim 10, further comprising computing third residuals of the implicit matrix equation based on the accelerated solution change, wherein said determining if the convergence condition is satisfied comprises determining if a magnitude of the third residuals interpreted as a vector is smaller than a threshold value.

12. A method for performing reservoir simulation using total velocity sequential preconditioning, wherein the reservoir is sub-divided into a plurality of cells, the method comprising:

formulating finite difference equations which describe a behavior of reservoir fluids over a timestep;

solving the finite difference equations by performing one or more Newton iterations, where each of said one or more Newton iteration comprises:

a) constructing a linear approximation for each non-linear term in the finite difference equations;

b) constructing an implicit matrix equation based on the finite difference equations and the linear approximations;

c) solving the implicit matrix equation, wherein said solving the implicit matrix equation comprises:

(c1) constructing a complementary matrix equation in terms of unknowns other than pressure using a constraint of conserving total velocity between cells;

(c2) solving the complementary matrix equation for improved estimates of unknowns other than pressure;

repeatedly performing said solving the finite difference equations in order to predict behavior of the reservoir fluids over time.

13. A method for performing reservoir simulation by solving an implicit matrix equation arising from a Newton iteration of an implicit reservoir model, wherein the reservoir model comprises a plurality of cells, wherein the implicit matrix equation includes unknown variables, the method comprising:

a) constructing a global IMPES pressure equation using the implicit matrix equation, wherein the global IMPES pressure equation comprises one scalar IMPES pressure equation for each of the plurality of cells;

b) solving the global IMPES pressure equation to determine first pressure values, wherein one of the first pressure values is associated with each of the plurality of cells;

c) computing improved estimates of the unknown variables other than pressure by performing one or more iterations of a preconditioner;

d) constructing a composite solution change by combining a first solution change associated with the first pressure values and a second solution change associated with the improved estimates of the unknown variables other than pressure;

e) providing the composite solution change to a solution accelerator;

f) the solution accelerator generating an accelerated solution change in response to the composite solution change;

g) repeatedly performing b) through f) until a convergence criteria is satisfied;

i) computing a final solution estimate based on the accelerated solution change after the convergence criteria is satisfied;

wherein the final solution change is utilized to predict a behavior of reservoir fluids at a future discrete time value.

14. The method of claim 12, wherein the solution accelerator comprises Orthomin.

15. The method of claim 13, wherein the solution accelerator comprises GMRES.

16. A method for performing reservoir simulation by solving an implicit matrix equation arising from a Newton iteration of an implicit reservoir model, wherein the implicit reservoir model comprises a plurality of cells, wherein the implicit matrix equation is expressed in terms of unknown variables including pressures, the method comprising:

a) constructing a global IMPES pressure equation using the implicit matrix equation, wherein the global IMPES pressure equation comprises one scalar IMPES pressure equation for each of the plurality of cells;

b) solving the global IMPES pressure equation to determine first improved estimates of the pressures, wherein one of the first improved estimates is associated with each of the plurality of cells;

c) computing second improved estimates of all the unknowns variables by performing one or more iterations of a preconditioner;

d) constructing a composite solution change in the unknown variables by combining a first solution change associated with the first improved estimates and a second solution change associated with the second improved estimates;

e) providing the composite solution change to a solution accelerator;

f) the solution accelerator generating an accelerated solution change;

g) determining if a convergence condition is satisfied;

h) repeatedly performing b) through g) until the convergence condition is satisfied;

i) computing a final solution estimate based on the accelerated solution change after the convergence condition is satisfied, and applying the final solution estimate to predict properties of reservoir fluids at a future time value.

17. The method of claim 16, further comprising computing second residuals of the implicit matrix equation based on the improved estimates of the unknown variables, wherein the second residuals are provided to the solution accelerator as input data.

18. The method of claim 16, further comprising computing third residuals of the implicit matrix equation based on the accelerated solution change, wherein said determining if the convergence condition is satisfied comprises determining if a magnitude of the third residual interpreted as a vector is smaller than a threshold value.

19. The method of claim 16, wherein the solution accelerator comprises Orthomin.

20. The method of claim 16, wherein the solution accelerator comprises GMRES.

* * * * *